US006190339B1

(12) United States Patent
Imazaike et al.

(10) Patent No.: US 6,190,339 B1
(45) Date of Patent: Feb. 20, 2001

(54) MASSAGE DEVICE

(75) Inventors: Mikiharu Imazaike; Hironori Iwamoto; Keiji Hata; Yoshiyuki Miyake, all of Osaka; Yoshikazu Okada, Shiga, all of (JP)

(73) Assignee: Matsushita Electric Works, Ltd., Osaka (JP)

( * ) Notice: Under 35 U.S.C. 154(b), the term of this patent shall be extended for 0 days.

(21) Appl. No.: 08/917,685

(22) Filed: Aug. 26, 1997

(30) Foreign Application Priority Data

Aug. 26, 1996 (JP) ..... 8-224202
Aug. 27, 1996 (JP) ..... 8-225597

(51) Int. Cl.[7] ..... A61H 7/00

(52) U.S. Cl. ..... 601/133; 601/135; 601/93; 601/95

(58) Field of Search ..... 601/133, 134, 601/135, 84, 89, 93, 95, 97, 101, 103

(56) References Cited

U.S. PATENT DOCUMENTS 3,536,064 * 10/1970 Kuroda ..... 601/93
4,615,336 * 10/1986 Fijimoto ..... 601/102
5,065,743 * 11/1991 Sutherland ..... 601/101
5,569,168 * 10/1996 Hartwig ..... 601/133
5,843,006 * 12/1998 Phillips et al. ..... 601/95

FOREIGN PATENT DOCUMENTS 4-827 1/1992 (JP) ..... A61H/7/00
404071555 * 3/1992 (JP) ..... 601/103
4-40025 7/1992 (JP) ..... A61H/7/00
406125952 * 5/1994 (JP) ..... 601/98

* cited by examiner

*Primary Examiner*—Michael A. Brown
*Assistant Examiner*—Benjamin Koo
(74) *Attorney, Agent, or Firm*—Sughrue, Mion, Zinn, Macpeak & Seas, PLLC

(57) ABSTRACT

A massage device has first and second massage members. The first massage member performs a circulating motion including (i) a massage zone where the member approaches the second massage member in a locus which swells in an outward direction as seen from a massage arm; and (ii) a release zone where the member separates from the second massage member in a locus which is shorter than the massage zone. The second massage member performs a reciprocal rocking motion in synchronization with the first massage member.

17 Claims, 16 Drawing Sheets

MASSAGE DEVICE

BACKGROUND OF THE INVENTION

1. Field of the Invention

The invention relates to an electric massage device (of the hand-held type, the chair-type, or the like) in which the massage action is performed by a pair of massage members.

2. Description of the Related Art

Conventionally, a known electric massage device in which the massage motion is performed by a pair of massage members and which is intended to produce a massage effect similar to a manual massage conducted by a massager has a structure in which the massage members are moved in a substantially oval locus having: a massage zone where the members approach each other; and a release zone where the members are separated from each other, as shown in Japanese Patent Publication No. Hei. 4-40025.

In the above massage device, the massage members respectively produce massage actions of different feelings, so that the resulting massage action is similar to that performed by fingers.

In the aforementioned known technique, the massage members move in the same manner both in the massage and release zones. Therefore, it is largely different from the technique which is called the thumb-grasping massage technique to be conducted by a massager (massage technique where the area to be massaged is grasped and lifted up while applying a force by the thumb), and in which the massage action is slowly performed and then the applied force is rapidly released.

Further, in the aforementioned massage device, the massage feeling is varied depending on the physique of a person to be massaged. Even when the same massage action is performed, for example, a person having a thin shoulder portion may feel that the massage action is weak, and a person having a thick shoulder portion may feel that the massage action is too strong. Furthermore, an opening which is formed in a case to allow an arm for each of the massage members to be movable is exposed. Consequently, there is a fear that a finger or the like is caught between an edge of the opening and the arm.

On the other hand, a massage device in which the space between massage members is adjustable has been proposed (Japanese Utility Model Publication No. Hei. 4-827). In the massage device, the space between massage members must be adjusted under a state where the body of the device is held with one hand and one of the massage members is grasped and pulled up with the other hand. Consequently, the adjusting work is cumbersome. The space is adjusted by swinging an arm of the massage member about a support shaft disposed on the basal end side. When the space is adjusted, therefore, the contact point where each massage member contacts with the area to be massaged is changed. The publication says nothing about the stop position of each massage member. In the case where the massage member which performs the massage action is stopped at an arbitrary position, when the massage device is once used on a person and then on another person of a different physique, an index of the space adjustment cannot be obtained unless the massage members are driven.

SUMMARY OF THE INVENTION

It is an object of the invention to provide a massage device which can produce a massage effect similar to that attained by the thumb-grasping massage technique conducted by a massager.

It is another object of the invention to provide a massage device in which the difference in massage feeling due to a difference in physique can be reduced.

It is a further object of the invention to provide a massage device in which a finger or the like is prevented from being caught by a moving massage member.

It is a still further object of the invention to provide a massage device in which the space between massage members can be easily adjusted.

It is a still further object of the invention to provide a massage device in which the space adjustment can be adequately conducted under a state where massage members are stopped.

According to a first aspect of the invention, there is provided a massage device comprising: a pair of massage arms; a pair of massage members being respectively disposed at tip ends of the massage arms; means for driving at least one of the massage arms and one of the massage members so as to change a space between the pair of massage members to perform a massage action; wherein the driving means is constituted so as to cause one driven massage member to perform a circulating motion including (i) a massage zone where one massage member approaches the other massage member in a locus which swells in an outward direction as view from the massage arms, and (ii) a release zone where one massage member separates from the other massage member in a locus which is shorter than the massage zone.

According to a second aspect of the invention, in the massage device according to the first aspect, the driving means causes the other massage member a reciprocal rocking motion between a squeezing position where the space between the other massage member and the one massage member is minimum, and a release position where the space between the other massage member and one massage member is maximum.

According to a third aspect of the invention, in the massage device according to the second aspect, the driving means has a driving system for the other massage member which performs the reciprocal rocking motion, the driving system including: a driving plate which is rotated by a motor; a cam groove which is formed around a rotation center of the driving plate; a cam shaft which engages with the cam groove; and a rocking block which is rocked about a fixed fulcrum by a cam action between the cam groove and the cam shaft, thereby rocking the other massage arm.

According to a fourth aspect of the invention, in the massage device according to the first aspect, the driving means has a driving system for one massage member which performs the circulating motion, the driving system comprising: a rotation plate which is rotated by a motor to give a circular motion force to a motion fulcrum of one massage arm; and a restriction arm which restricts a motion locus of one massage arm so that one massage member performs the circulating motion having the massage zone and the release zone.

According to a fifth aspect of the invention, in the massage device according to the first aspect, the other massage arm is fixed.

According to a sixth aspect of the invention, in the massage device according to the second aspect, the driving means stops the other massage member which performs the reciprocal rocking motion, for a predetermined time period including a timing when one massage member which performs the circulating motion reaches an endpoint of the massage zone.

According to a seventh aspect of the invention, in the massage device according to the second aspect, the driving means stops the other massage member which performs the reciprocal rocking motion at the squeezing position of the other massage member, for a predetermined time period.

According to an eighth aspect of the invention, in the massage device according to the first aspect, at least one of the massage arms is configured as an articulate link mechanism in which two arms are connected at one end to each other by a pin, and a spring which urges the two arms toward a usual action position is disposed in an arcuate portion of one of the massage arms.

According to a ninth aspect of the invention, in the massage device according to the first aspect, at least one of the massage arms are positionally changeable, and the device further comprising space adjusting means for adjusting a position of one of the the massage arms in a direction along which a space between the pair of massage members.

According to a tenth aspect of the invention, in the massage device according to the ninth aspect, the space adjusting means moves in parallel the positionally-changeable massage member and massage arm in a state where a massaging face of the positionally-changeable massage member is substantially unchanged in direction at any adjust position.

According to an eleventh aspect of the invention, in the massage device according to the tenth aspect, the space adjusting means is configured by a quadru-link mechanism.

According to the aforementioned configuration, when a shoulder is to be massaged, for example, the massage member which performs the circulating motion slowly massages the shoulder in the locus which swells in an outward direction and then rapidly separates from the shoulder in the shorter locus, as the motion of the thumbs in the thumb-grasping massage technique conducted by a massager. Therefore, it is possible to attain a high massage effect.

In this case, according to the configuration in the second aspect, the other massage member performs the rocking motion to support the pressing force exerted by the one massage member at the squeezing position, thereby enhancing the massage effect, and is then moved from the squeezing position to the release position to perform the motion of canceling the pressing force (rapidly releasing the force). Therefore, it is possible to attain a massage action which is more similar to the thumb-grasping massage technique.

According to the configuration in the sixth aspect, the massage member which performs the rocking motion stops for a predetermined time period including a timing when the massage member which performs the circulating motion reaches the massage endpoint. Therefore, it is possible to obtain a motion in which the pressing force is accumulated at the peak of massage exerted by the thumbs and then rapidly released, and hence the massage feeling becomes more similar to that exerted by a massager.

According to the configuration in the seventh aspect, the other massage member stops at the squeezing position where the pressing force is maximum, and hence the effect is further enhanced.

According to the configuration in the eighth aspect, as the massage proceeds, the pressing force is increased by the spring, and hence it is possible to obtain an optimum motion in which the massage is conducted while gradually increasing the pressing force.

When an excessive force is applied as in the case where a bone or the like is pressed, moreover, the arm to which the massage member is attached is swung in a relief direction so as to exert a function of preventing overload. Therefore, both the human body and the massage arms are prevented from receiving an excessive force.

According to the configuration in the ninth aspect, the space between the massage members is adjustable, and hence it is possible to obtain an optimum massage span according to, for example, the physique of a person to be massaged.

In this case, according to the configuration of tenth and eleventh aspects, the massaging face of the massage member is substantially unchanged at any size of the space, and hence it is possible to ensure a constant massage effect irrespective of variation of the space.

According to a twelfth aspect of the invention, the massage device according to the first aspect, further comprises: a roller which is rotatably disposed at a tip end of at least one of the massage arms, and one of the massage members is disposed on one of the massage arms via the roller.

According to this configuration, when one massage arm is swung about the fulcrum shaft, the massage member disposed on the massage arm is moved in the approaching and separating directions with respect to the other massage member, and, when the massage arm is swung, the angle of the massage arm with respect to the approaching and separating directions is changed. The massage member is disposed on the massage arm via the roller which is rotatably disposed at a tip end of the massage arm. Even when the angle of the massage arm with respect to the approaching and separating directions is changed, therefore, the rotation of the roller enables the angle of the massage member to be maintained constant. As a result, the area to be massaged is always adequately captured by the massage members. Further, the roller is not restricted to a column-like member, and may be a member of any shape as far as it is rotatable.

According to a thirteen aspect of the invention, there is provided a massage device comprising: a body having an opening formed in a surface thereof; a pair of massage arms being respectively projected from the opening; a pair of massage members which are disposed so as to respectively cover tip ends of the massage arms; means for driving the massage arms, thereby causing the massage members to perform a massage action; and a cover disposed between the surface of the body and the massage members and covering the opening.

According to this configuration, the device comprises the covers disposed between the surface of the body of the device and the massage members and covering the openings which are formed in the surface of the body of the device so as to have a size corresponding to a range of the massage operation. Therefore, a finger or the like is prevented from being caught between one of the massage members and the corresponding opening. Furthermore, noises which are generated by driving the massage members and which leak to the outside are reduced in level. Still further, the covers may be molded integrally with the respective massage members. According to this configuration, the device can be configured in a further simplified manner.

According to a fourteen aspect of the invention, in the massage device according to the first aspect, the space adjusting means comprises: a massage arm support member which supports one of the massage arms so as to be swingable about a fulcrum shaft disposed on one of the massage arms, and which has a plurality of engaging grooves facing toward a tip end of one massage arm; an engaging member which is attached to one of the massage arms, and which is movable between an engagement state and a cancel state with respect to the engaging grooves; an urging member which is disposed between the engaging member and the fulcrum shaft, and which produces an urging force in an engagement direction; and a cancel operation member which has a head portion projected from a body of the device, and which, when the head portion is pressed, moves the engaging member against the urging force, thereby canceling the engagement state of the engaging member with respect to the engaging grooves.

According to this configuration, when the head portion of the cancel operation member is pressed, the engagement state of the engaging member with respect to the engaging grooves is canceled, and the massage arm is swung about the fulcrum shaft disposed on the massage arm under this cancel state, thereby adjusting the space between the massage members which are respectively disposed at tip ends of the massage arms. Therefore, the space adjustment can be easily conducted with one hand.

According to a fifteen aspect of the invention, there is provided a massage device comprising: a pair of massage arms; a pair of massage members which are respectively disposed at tip ends of the massage arms; driving means for driving the massage arms to change a space between the massage members, thereby causing the massage members to perform a massage action; and instructing means for instructing a stop of an operation of the driving means; and controlling means for, when the instructing means produces an instruction, stopping the operation of the driving means at a timing when the space between the massage members has a preset size.

According to this configuration, when the driving means is instructed to stop the operation, the operation of the driving means is stopped at a timing when the space between the massage members has a preset size, with the result that, during a period when the driving means stops, the size of the space between the massage members is always maintained to be equal to the preset size. Consequently, an index of the space adjustment can be easily obtained.

And the controlling means may comprise detecting means for detecting that the space between the massage members has a maximum size, and stop the operation of the driving means at the timing when the space between the massage members is maximum in size. According to this configuration, the driving means is always stopped under the state where the space between the massage members is maximum in size. Therefore, the device can be easily detached from the area to be massaged, and, when the operation is to be restarted, readily applied to the area to be massaged.

Further, the device may further comprise space adjusting means for adjusting the space between the massage members. According to this configuration, during a period when the driving means stops, the size of the space between the massage members is always maintained to be equal to a preset size. Consequently, an index of the space adjustment can be easily obtained.

DETAILED DESCRIPTION OF THE PREFERRED EMBODIMENTS

Embodiments of the invention will be described with reference to the figures.

Hereinafter, embodiments in which the invention is applied to a hand-held massage device will be described. However, the invention can be applied to a massage device of any type including the chair type.

Figure 1:
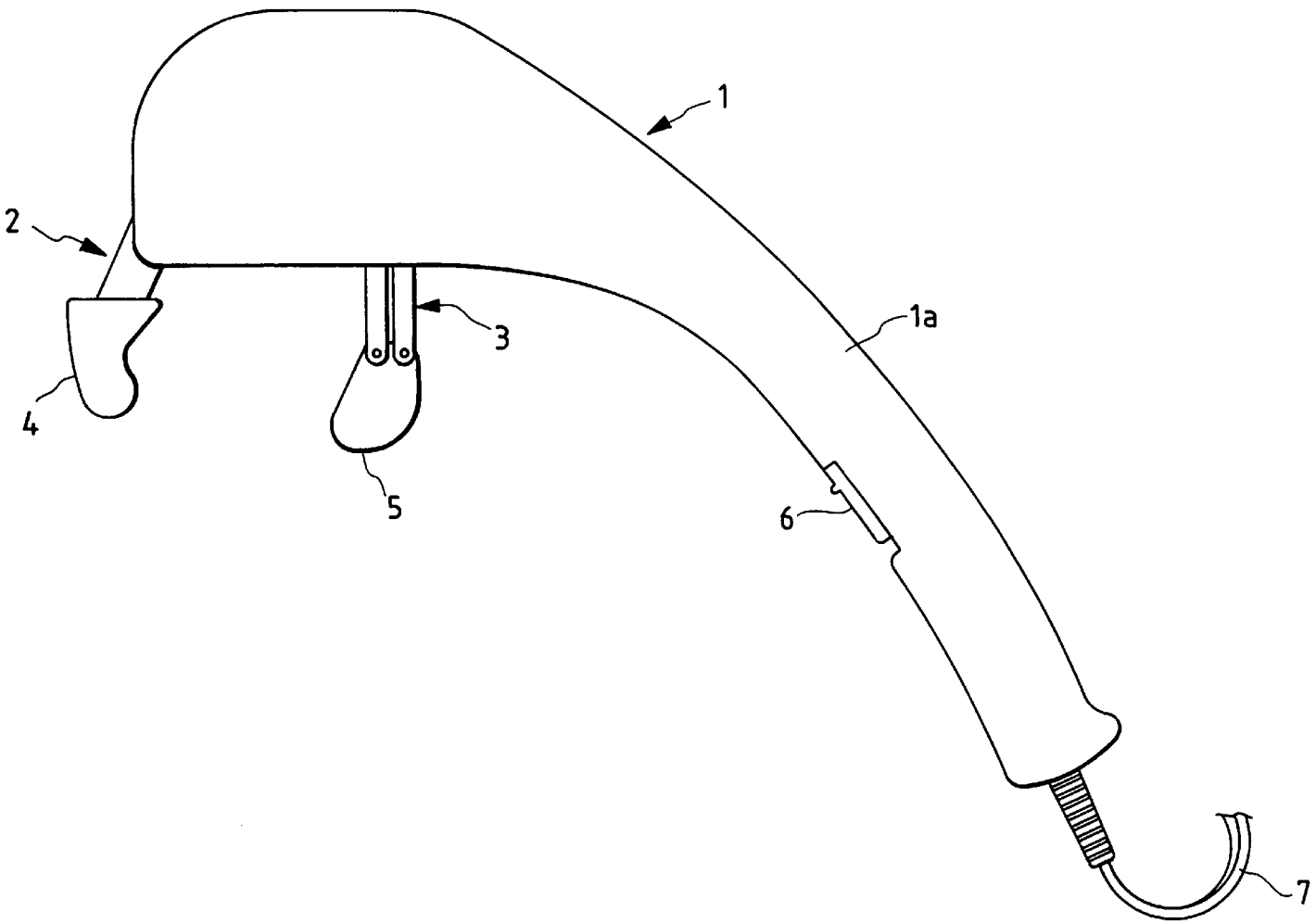
FIG. 1 is an external view of a massage device of a basic embodiment of the invention.

FIG. 1 shows an external appearance of the whole of the massage device.

The reference numeral 1 designates a body case. A pair of massage arms (hereinafter, referred to as first and second massage arms) 2 and 3 are disposed in the tip end portion of the body case 1 so as to be protruded to the outside of the case. First and second massage members 4 and 5 are attached to the first and second massage arms 2 and 3, respectively.

The body case 1 has a thin hand-held portion la at the basal area so as to be easily held with one hand. An operation switch 6 which causes a motor functioning as a driving source described later to rotate and stop is disposed in the hand-held portion la. The reference numeral 7 designates a power cord.

Figure 2:
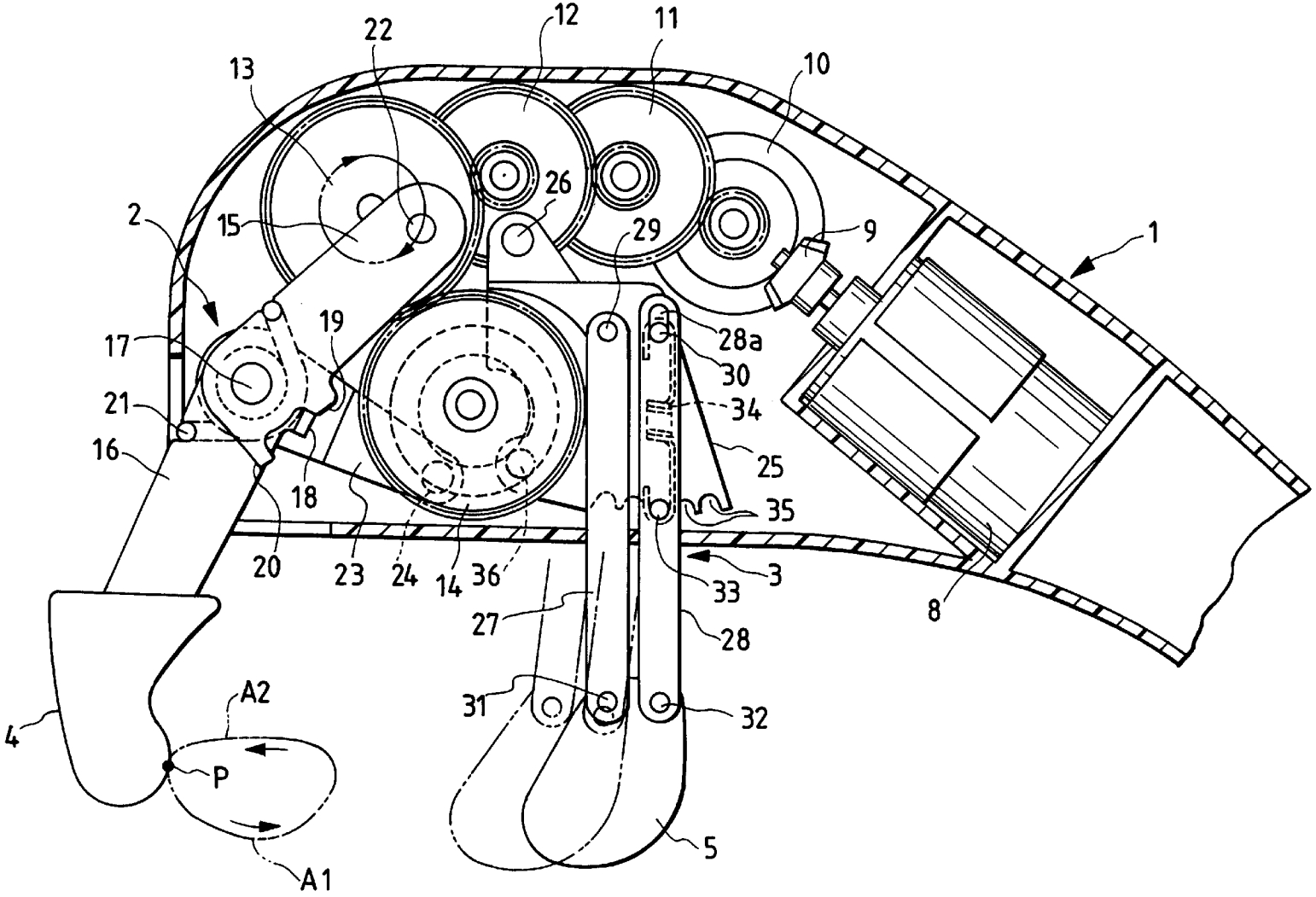
FIG. 2 is an enlarged section view of main portions of the massage device.

FIG. 2 shows driving means for the massage members 4 and 5.

The reference numeral 8 is the motor functioning as the driving source. The rotation force of the motor 8 is transmitted to a first driving gear (rotation plate) 13 for driving the first massage member via a gear reduction mechanism comprising gears 9, 10, 11, and 12. The force is further transmitted from the first driving gear 13 to a second driving gear (driving plate) 14 for driving the second massage member.

The first and second driving gears 13 and 14 have the same number of teeth so as to rotate at the same speed.

The first massage arm 2 is configured as an articulate link mechanism which is bendable and extendable and in which a first arm 15 on the side of the basal end, and a second arm 16 on the side of the tip end to which the first massage member 4 is attached are connected to each other at each one end portion by a connecting pin 17 so as to be mutually swingable.

In the area of the first massage arm 2 where the arms 15 and 16 are connected to each other, an abutting pawl 18 is disposed on the second arm 16, and first and second stoppers 19 and 20 are formed in the first arm 15 so as to face each other with the abutting pawl 18 therebetween. These components cooperate to restrict the angle formed by the arms 15 and 16 to a fixed range.

A spring 21 which urges the arms 15 and 16 in the bending direction is attached to the connecting pin 17. As indicated by the solid lines in FIG. 4, usually, the force of the spring 21 causes the abutting pawl 18 to abut against the first stopper 19 so as to fix the angle formed by the arms 15 and 16, thereby maintaining a normal action state in which the first massage arm 2 is slightly bent.

Figure 4:
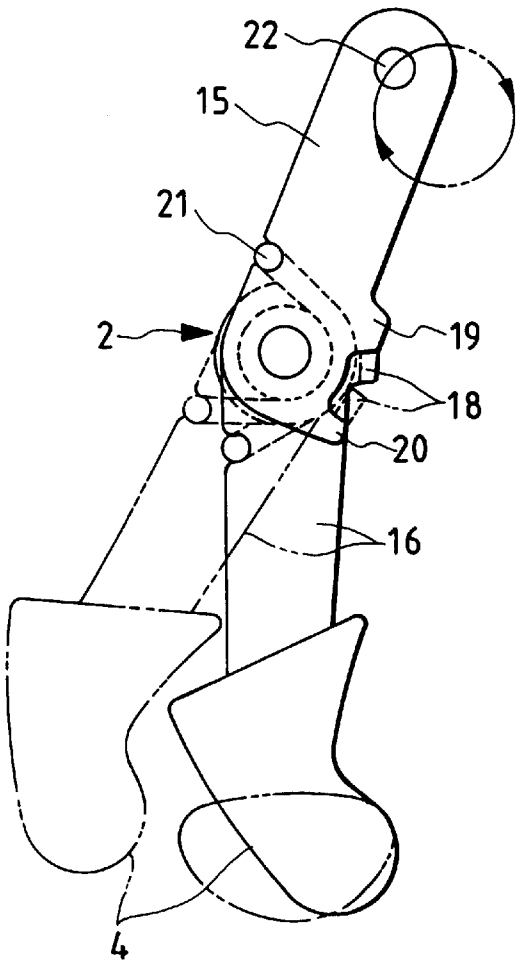
FIG. 4 is a side view showing the first massage member and a first massage arm to which the first massage member is attached.
Figure 3:
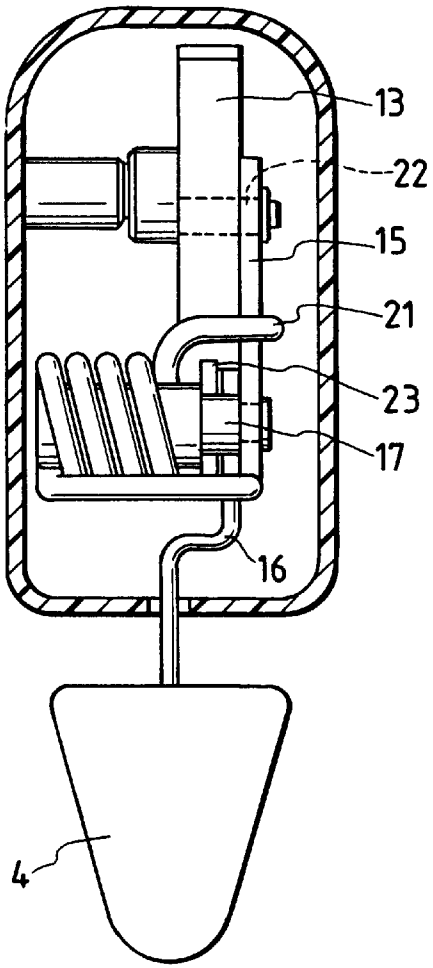
FIG. 3 is a vertical section view showing a driving system for a first massage member of the massage device.

By contrast, when an excessive force is applied to the massage member 2 during use, the second arm 16 is swung about the connecting pin 17 in the relief direction (extension direction) within a range where the abutting pawl 18 abuts against the second stopper 20 as indicated by the phantom lines in FIG. 4, thereby relieving the force.

The basal portion of the first arm 15 of the first massage arm 2 is connected to the first driving gear 13 by a support shaft 22 at a position which is deviated from the center of the gear. When the first driving gear 13 is rotated, the support shaft 22 performs a circular motion.

A restriction arm 23 is attached at a position opposing the connecting portion of the arms 15 and 16 so as to be rockable about a stationary support shaft 24. The tip end portion of the restriction arm 23 is attached to the connecting pin 17.

The principle of the operation of the first massage member 4 will be described with reference to FIGS. 2, 5(*a*)–5(*d*) and 6.

When the support shaft 22 performs a circular motion about the center of the first driving gear 13 as a result of the rotation of the gear, the connecting pin 17 rocks about the stationary support shaft 24 in the vertical direction in the figure, with a constant radius and a constant rocking amplitude which are restricted by the restriction arm 23.

Figures 5A, 5B, 5C, 5D:
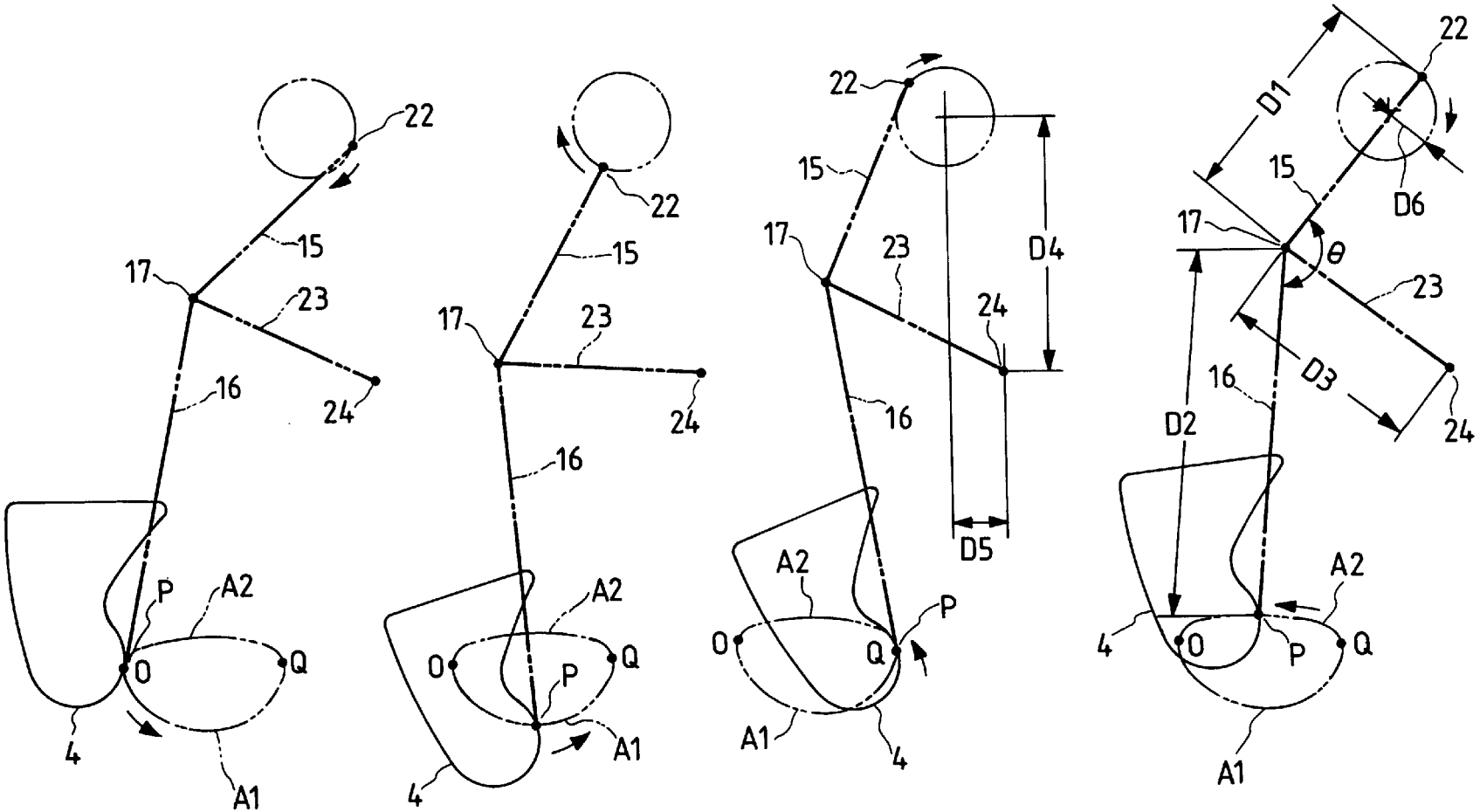
FIGS. 5(*a*) to 5(*d*) are views showing the principle of the operation of the first massage member.

As a result, the massage point P of the first massage member 4 performs a circulating motion in a counterclockwise direction as shown in FIGS. 2, 5(*a*)–5(*d*), and 6.

Specifically, the massage point P performs a circulating motion having: a massage zone A1 where the point moves from the position (hereinafter, referred to as the original) O which is remotest from the second massage member 5 as shown in FIG. 5(*a*), to the position (hereinafter, referred to as the massage endpoint) Q which is closest to the second massage member 5 as shown in FIG. 5(*c*) in an arcuate locus which swells in an outward direction as seen from the massage arm 2; and a release zone A2 where the point moves from the massage endpoint Q to the original O of FIG. 5(*a*) via the point shown in FIG. 5(*d*) in a locus which is shorter than the massage zone A1 and which is approximately linear.

In other words, conditions of the driving system for the first massage member 4, such as the deviation amount of the support shaft 22 from the center of the first driving gear, the distance and positional relationships between the support shafts 22 and 24, and the distance between the connecting pin 17 and the stationary support shaft 24 are set so that such loci of the circulating motion are obtained. Further, it takes longer time to move over the whole massage zone than to move over the whole release zone.

Furthermore, it should be allowed that the locus length of the massage zone A1 is set to be equal to the locus length of the release zone A2. In this case, the conditions of the driving system is determined such that the time during which the massage member 4 moves in the massage zone A1 is longer than that in the release zone A2. That is, the massage member 4 moves faster in the release zone A2 than in the massage zone A1.

In this embodiment, the specifications are designated in FIGS. 5(*a*) to 5(*d*). The distance D1 between the connecting pin 17 and the support shaft 22 is 49.0 mm; the distance D2 between the connecting pin 17 and the massage point P is 76.6 mm; the distance D3 between the connecting pin 17 and the stationary support shaft 24 is 42.0 mm; the distance D4 between the rotation center of the first driving gear 13 and the stationary support shaft 24 in the vertical direction is 53.5 mm; the distance D5 between the rotation center of the first driving gear 13 and the stationary support shaft 24 in the horizontal direction is 13.5 mm; and the distance D6 between the rotation center of the first driving gear 13 and the support shaft 22 is 10.5 mm. The angle θ between the arms 15 and 16 is 143. 8° when the massage point P is at the substantially intermediate point in the locus between the massage endpoint Q and the original O shown in FIG. 5(*d*).

Figure 6:
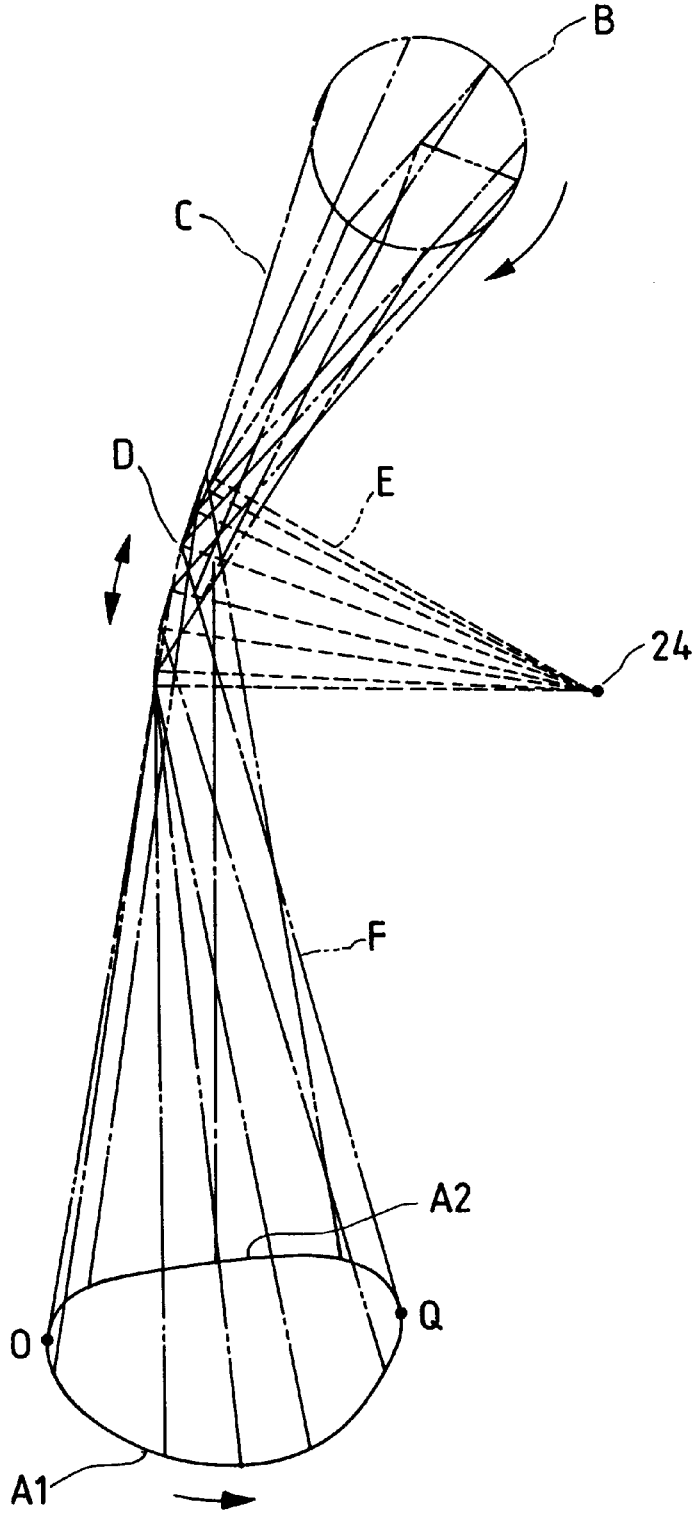
FIG. 6 is a view illustrating a motion locus of a massage point of the first massage member.

In FIG. 6, B, C, D, E, and F indicate motion loci of the support shaft 22, the first arm 15, the connecting pin 17, the restriction arm 23, and the second arm 16, respectively. In this embodiment, the locus B is the uniform motion.

In FIGS. 2, 7, and 8, 25 designates a rocking block which is attached to the body case 1 so as to be rockable back and forth about a rocking support shaft 26. The basal portions of a pair of links (hereinafter, respectively referred to as the front link and the rear link) 27 and 28 which are arranged in parallel are attached to the rocking block 25 by link attaching pins 29 and 30, thereby constituting the second massage arm 3. The second massage member 5 is attached to the tip end portions of the links 27 and 28 by massage member attaching pins 31 and 32.

In this way, the second massage arm 3 (the links 27 and 28), the rocking block 25, and the second massage member 5 constitute a quadru-link mechanism.

In the rear link 28 of the second massage arm 3, an attaching hole 28*a* for the rocking block 25 is formed as an oblong hole so that the link attaching pin 30 is movable in the attaching hole 28*a*.

An engaging pin 33 is projected and extending at a middle portion of the rear link 28, and a tension spring 34 is attached so as to straddle the engaging pin 33 and the attaching pin 30.

A plurality of engaging grooves 35 are formed in the tip end of the rocking block 25. The engaging pin 33 is engaged with one of the engaging grooves 35 by a resilient force exerted by the tension spring 34.

Figure 7:
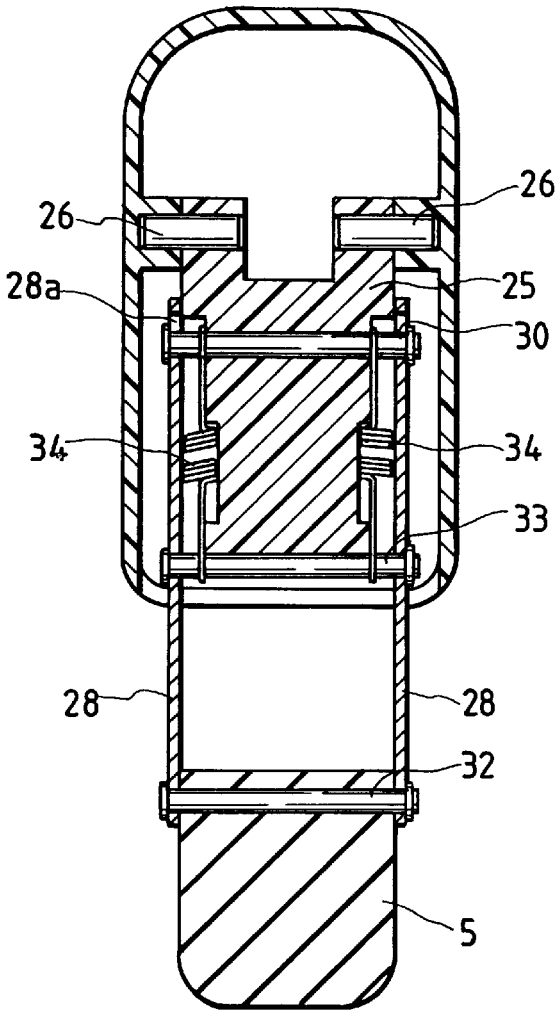
FIG. 7 is a vertical side section view showing a driving system for a second massage member.
Figure 8:
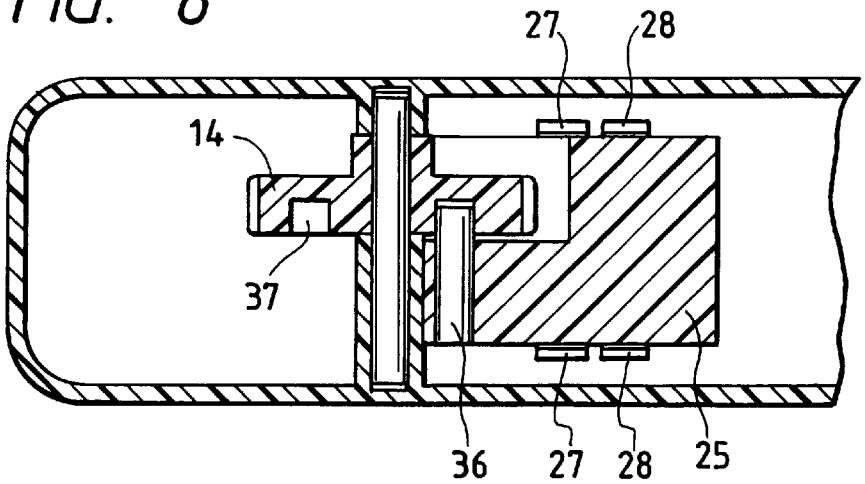
FIG. 8 is a horizontal section view of the driving system.

As shown in FIGS. 7 and 8, the links 27 and 28 constituting the second massage arm 3 are disposed on both the lateral sides of the rocking block 25. The link attaching pins 29 and 30, and the massage member attaching pins 31 and 32 are disposed across the two links on both the lateral sides. The tension springs 34 are also disposed on both the lateral sides.

A cam shaft 36 is disposed in the side of the tip end of the rocking block 25. A cam groove 37 is formed about the rotation center of the second driving gear 14. The cam shaft 36 is engaged with the cam groove 37.

Figure 9:
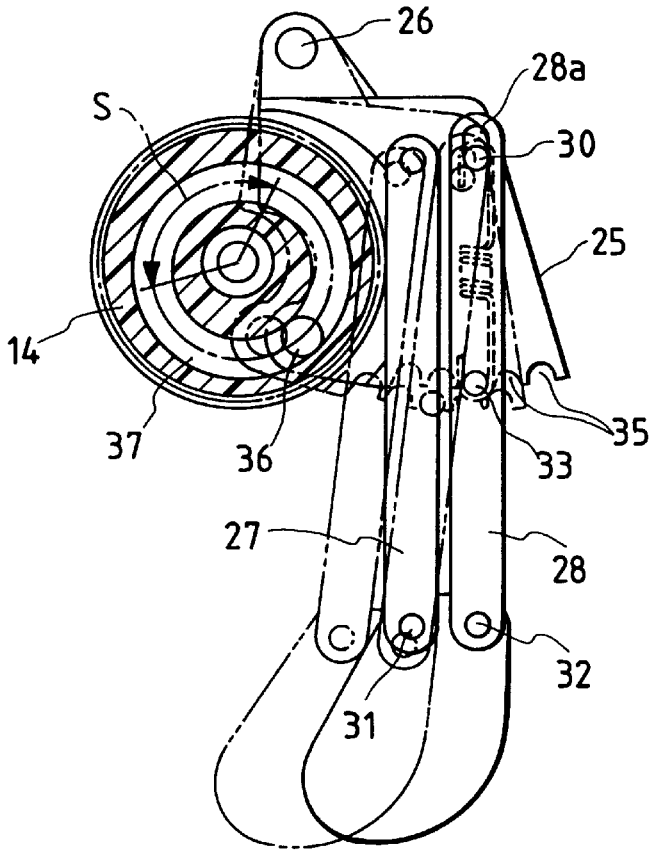
FIG. 9 is a partial enlarged section view of the driving system for the second massage member of FIG. 2.

As shown in FIG. 9, the cam groove 37 is formed so that the deviation amount from the center of the driving gear is changed in the rotation direction. The change in deviation amount causes the cam shaft 36 to rock back and forth in accordance with the rotation of the second driving gear 14. The rocking force is transmitted to the second massage member 5 via the second massage arm 3.

According to this configuration, in synchronization with the first massage member 4, the second massage member 5 performs a reciprocal rocking motion between (1) a squeezing position where a space between the massage member 5 and the massage member 4 is minimum (the position indicated by the phantom lines in FIGS. 2 and 9), and (2) a release position (the position indicated by the solid lines in FIGS. 2 and 9) where the space between the massage member 5 and the massage member 4 is maximum, so that (a) the massage member 5 reaches the squeezing position at or immediately before the timing when the first massage member 4 reaches the massage endpoint, and (b) the massage member 5 reaches the release position at the timing when the first massage member 4 reaches the original.

Figure 10:
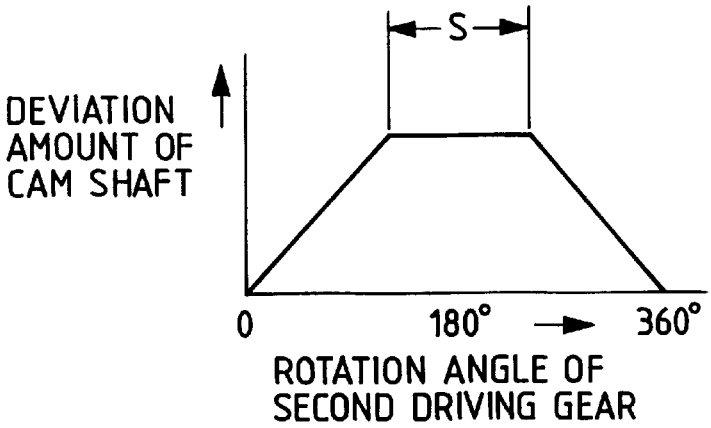
FIG. 10 is a view showing properties of a cam mechanism of the driving system.
Figure 11A:
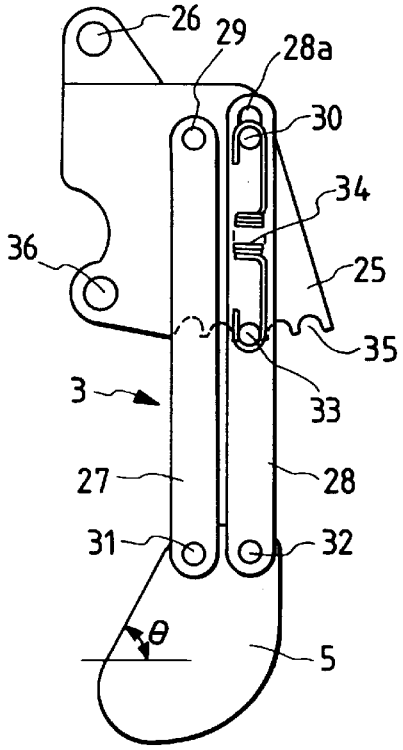
FIGS. 11(*a*) to 11(*d*) are views illustrating a space adjusting action of the second massage member.
Figure 11B:
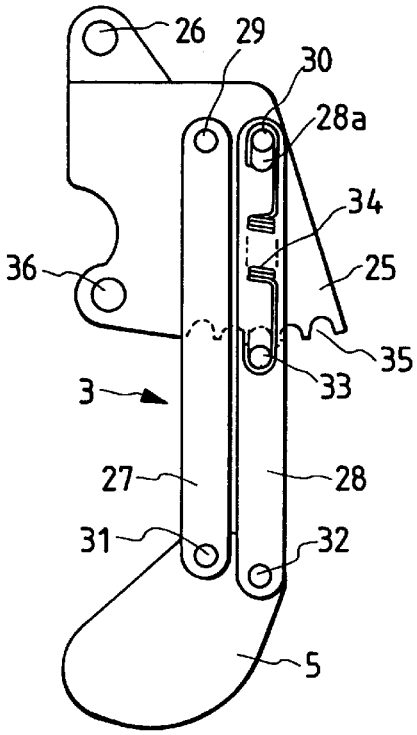
Figure 11C:
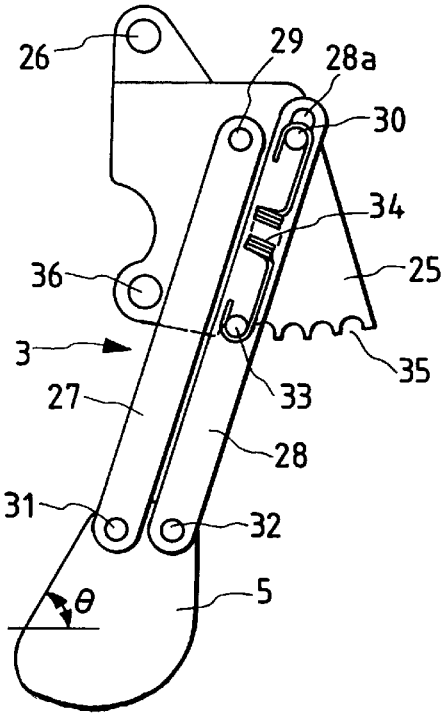
Figure 11D:
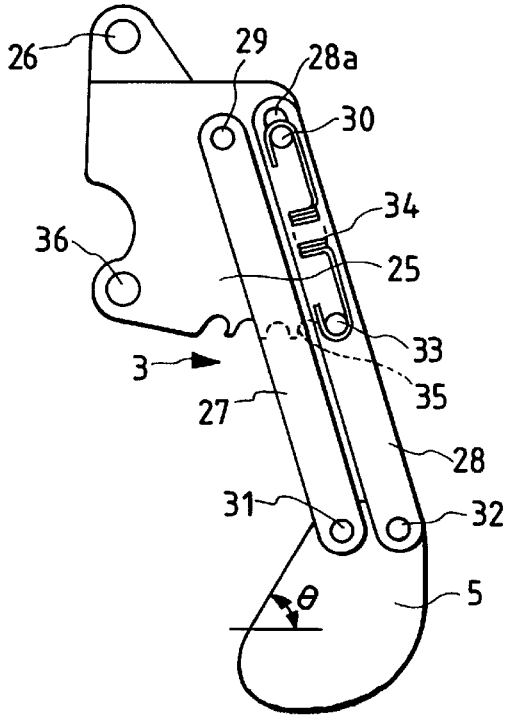

As shown in FIGS. 9 and 10, the cam groove 37 is provided with a stop zone S over a certain angular range (for example, 120 deg.) in which the deviation amount is not changed (the cam shaft 36 is not displaced even when the second driving gear 14 is rotated).

The stop zone S is set so as to start at the timing when the second massage member 5 reaches the squeezing position (at or immediately before the timing when the first massage member 4 reaches the massage endpoint).

Next, the function of the massage device will be described.

(i) Massage action

When a shoulder is to be massaged, for example, the first and second driving gears 13 and 14 are rotated under a state where the shoulder is sandwiched between the massage members 4 and 5. Then, the first massage member 4 performs the circulating motion having the massage zone A1 and the release zone A2, and the second massage member 5 performs the reciprocal rocking motion which is synchronized with the circulating motion, thereby conducting the massage action.

Since the motion locus of the first massage member 4 is set so that the massage zone A1 is longer and the release zone A2 is shorter, the first massage member 4 performs a motion similar to that of the thumbs in the thumb-grasping massage technique conducted by a massager in which the massage member 4 slowly massages the shoulder in the arcuate locus (the massage zone A1) which swells in an outward direction, and then rapidly separates from the shoulder in the shorter locus (the release zone A2) which is approximately linear.

Therefore, it is possible to attain a massage effect higher than that attained by a known massage device in which the motions of massage members in the massage zone are strictly symmetrical with those in the release zone.

Furthermore, the second massage member 5 performs the rocking motion to support the pressing force exerted by the first massage member 4 at the squeezing position, thereby enhancing the massage effect, and is then moved from the squeezing position to the release position to perform the motion of canceling the pressing force (rapidly releasing the force).

Therefore, it is possible to attain a massage action which is more similar to the thumb-grasping massage technique.

Furthermore, the second massage member 5 stops at the squeezing position where the pressing force is maximum, and for a predetermined time period including a timing when the first massage member 4 reaches the endpoint of the massage zone. Therefore, it is possible to obtain a motion in which the pressing force is accumulated at the peak of massage exerted by the thumbs and then rapidly released, and hence the massage feeling becomes more similar to that exerted by a massager.

As the massage proceeds, the pressing force is increased by the spring 21 disposed in the articulation of the first massage arm 2, and hence it is possible to obtain a motion which is most suitable for the massage and in which the massage is conducted while gradually increasing the pressing force.

When an excessive force is applied as in the case where a bone or the like is pressed, moreover, the second arm 16 of the first massage arm 2 is swung about the connecting pin 17 in the extendable direction as indicated by the phantom lines in FIG. 4 so as to exert a function of preventing overload. Therefore, both the human body and the massage arms 2 and 3 are prevented from receiving an excessive force.

(ii) Space adjusting action

When the second massage member 5 in a state of FIG. 11(*a*) is grasped by a hand so as to be tilted in an upward and leftward direction as shown in FIG. 11(*b*), the rear link 28 of the second massage arm 3 is moved against the tension spring 34 toward the lower side of the figure, so that the engaging pin 33 is disengaged from the one of the engaging grooves 35.

This causes the second massage arm 3 to be freely movable. When the massage arm 3 is swung under this state in the forward direction as shown in FIG. 11(*c*) or in the rearward direction as shown in FIG. 11(*d*), the space between the massage members 4 and 5 can be adjusted.

When the second massage member 5 is released after adjustment, the engaging pin 33 is engaged with one of the engaging grooves 35 corresponding to the adjustment position by the resilient force exerted by the tension spring 34, thereby fixing the second massage arm 3 to the adjustment position.

In this way, the space between the massage members 4 and 5 can be arbitrarily adjusted. Therefore, it is possible to obtain an optimum massage span according to, for example, the physique of a person to be massaged.

In this case, the second massage arm 3, the rocking block 25, and the second massage member 5 constitute a quadrulink mechanism, and the massage member 5 is moved back and forth in parallel by the mechanism. At any size of the space, therefore, the orientation (angle θ) of the massaging face of the second massage member 5 is unchanged.

As a result, even when the space is arbitrarily adjusted, it is possible to ensure a constant massage effect.

The constitution of the present ivnention is not limited to that of the above embodiment. It is possible to modify the above embodiment from the other views.

Figure 12:
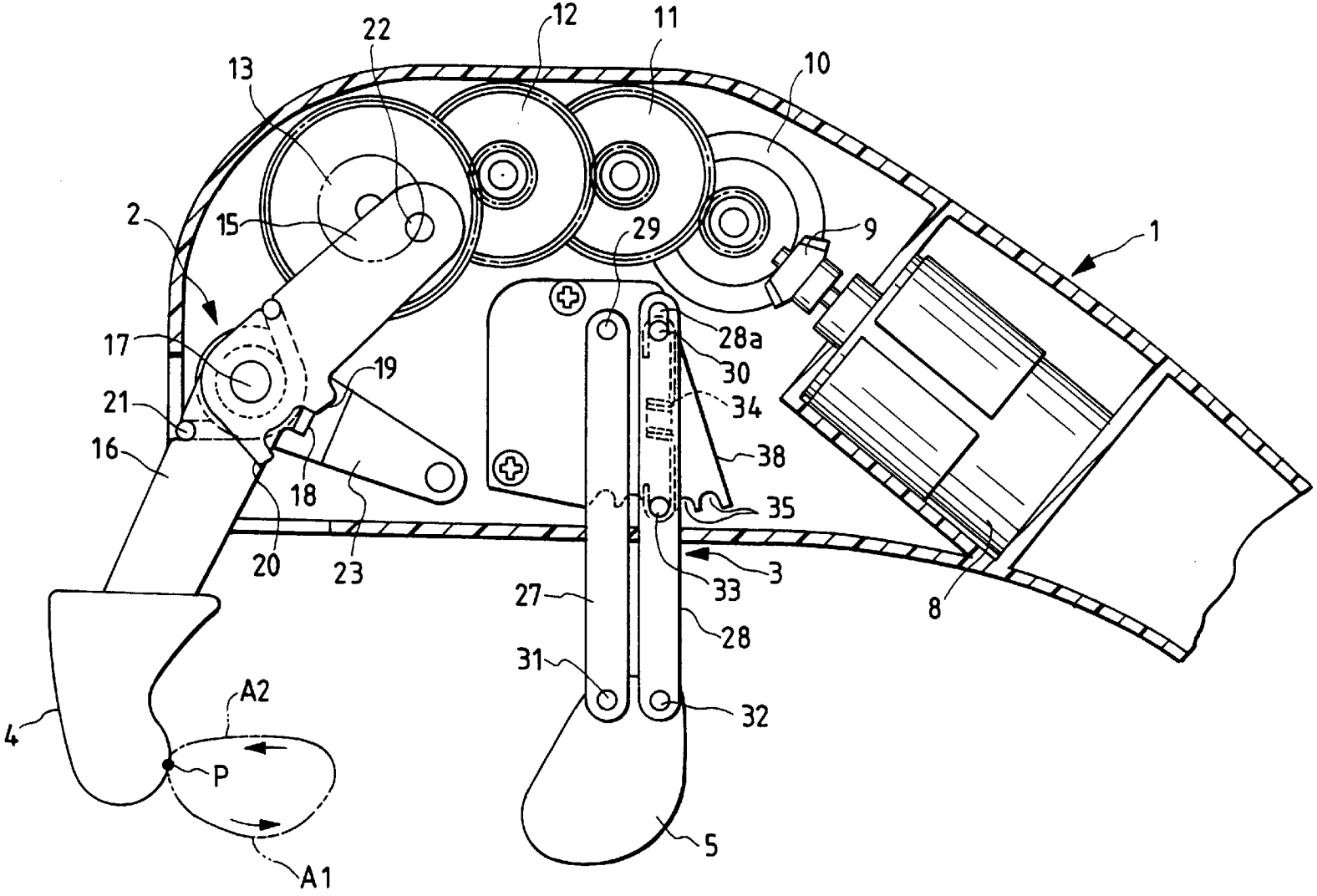
FIG. 12 is a view of a massage device of another embodiment of the invention, and corresponding to FIG. 2.

(1) In the basic embodiment described above, the second massage member 5 is reciprocally rocked back and forth. Alternatively, the second massage member 5 may be configured as an unmovable part or fixedly formed as shown in FIG. 12.

In the figure, 38 designates a stationary block fixed to the body case 1. The basal portion of the second massage arm 3 (the links 27 and 28) is attached to the stationary block 38.

The other components such as the space adjusting means are configured in the same manner as those of the basic embodiment, and hence their description is omitted.

According to this configuration, the second massage member 5 conducts only the function of supporting the pressing force exerted by the first massage member 4.

Also in the embodiment, the first massage member 4 performs the motion in which the massage action is slowly performed and then the applied force is rapidly released, and hence it is possible to attain an excellent massage effect.

(2) Both the massage members may be configured so as to perform the circulating motion which, in the basic embodiment, is performed by the massage member 4. In this case, the above-mentioned massage action is applied on both the sides of the area to be massaged.

(3) In the basic embodiment, the first massage arm 2 is configured as an articulate link mechanism by the first and second arms 15 and 16. Alternatively, the massage arm 2 may be configured by a single arm.

(4) In the basic embodiment, the space adjusting means is configured so that the second massage member 5 is moved in parallel back and forth by the quadru-link mechanism. Alternatively, the second massage arm 3 may be configured by a single arm and the space adjustment may be realized by swinging the second massage member 5 about a specific fulcrum.

Figure 13:
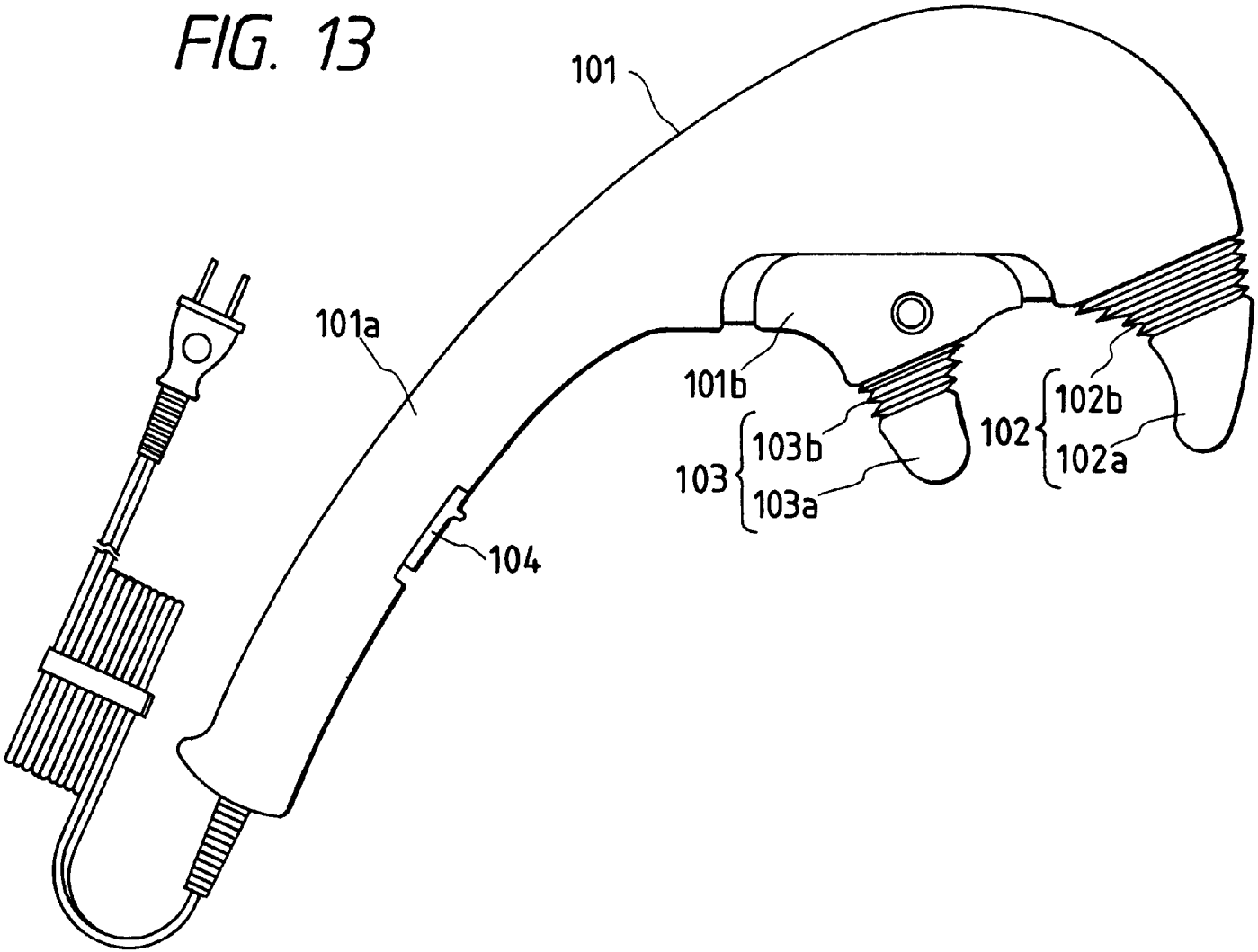
FIG. 13 is an external view of a still another embodiment of the massage device of the invention.
Figure 14:
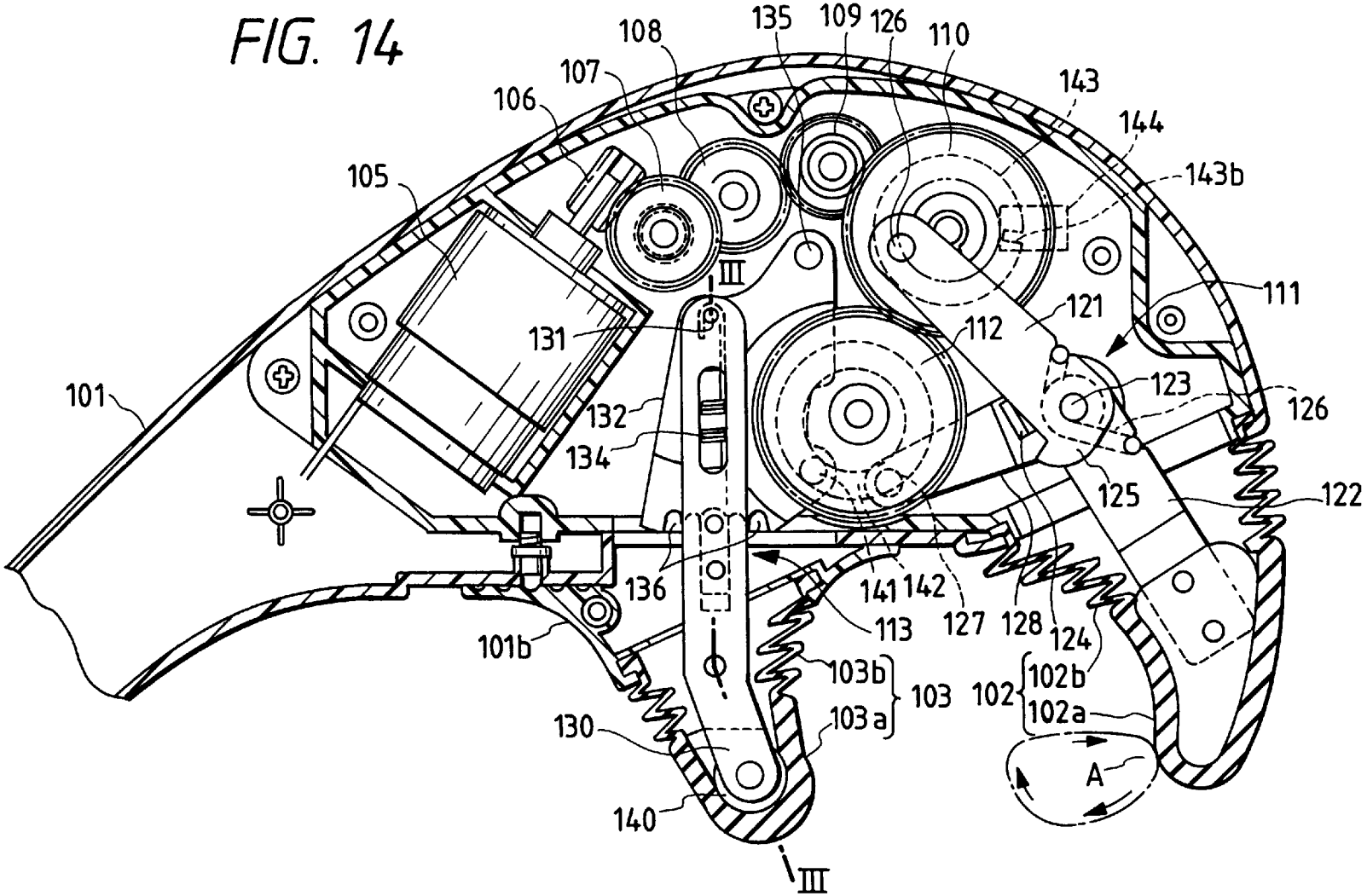
FIG. 14 is a section view of main portions of the embodiment in FIG. 13.

FIG. 13 is an external view of still another embodiment of the massage device of the invention, and FIG. 14 is a section view of main portions of this embodiment.

As shown in FIG. 13, the massage device comprises the device body 101 provided with a power cord having an attachment plug at a tip end. The device body 101 comprises a pair of massage members, or a first massage member 102 and a second massage member 103 which are protruded from the tip end side of the device body. The device body 101 has a thin hand-held portion 101*a* at the basal area so as to be easily held with one hand. An operation switch 104 which turns on and off the operation of the massage device is disposed in the hand-held portion 101*a*.

As shown in FIG. 14, the first and second massage members 102 and 103 are configured by respectively integrally molding massage portions 102*a* and 103*a* which have a substantially rounded conical tip end and which contact with the area to be massaged, and bellow-type covers 102*b* and 103*b* which are formed so as to be extendable and contractable in accordance with the movement for the massage action performed by the massage portions 102*a* and 103*a*.

The basal portion of the cover 102*b* of the first massage member 102 is fixed to the device body 101, and that of the cover 103*b* of the second massage member 103 is fixed to a slide cover 101*b*. The slide cover 101*b* is attached to the device body 101 so as to be slidable, and has space adjust buttons 101*c* which will be described later, at a substantially center area.

Figure 15A:
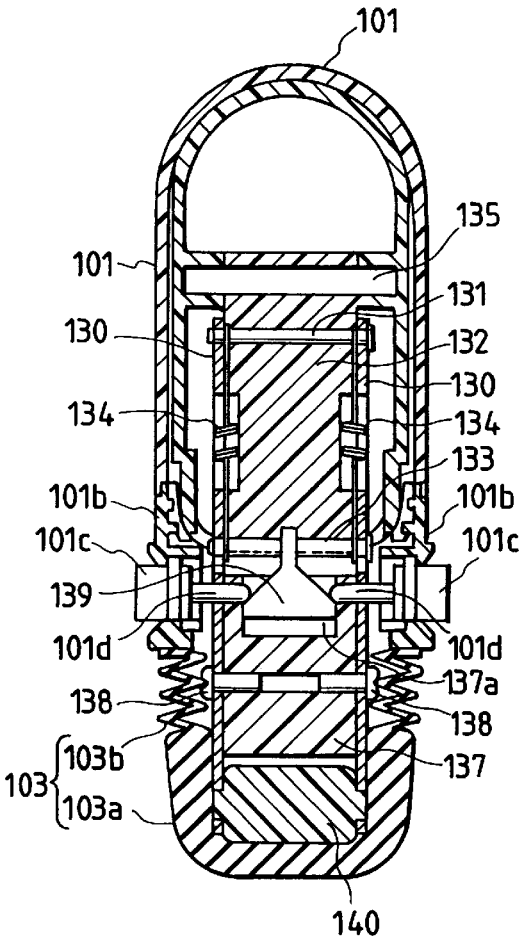
FIGS. 15(*a*) and 15(*b*) are section views taken along line III—III of FIG. 14 and showing the configuration of a second massage arm, and FIG. 15(*a*) shows a state where an engaging pin is engaged, and FIG. 15(*b*) shows a state where the engaging pin is disengaged.
Figure 15B:
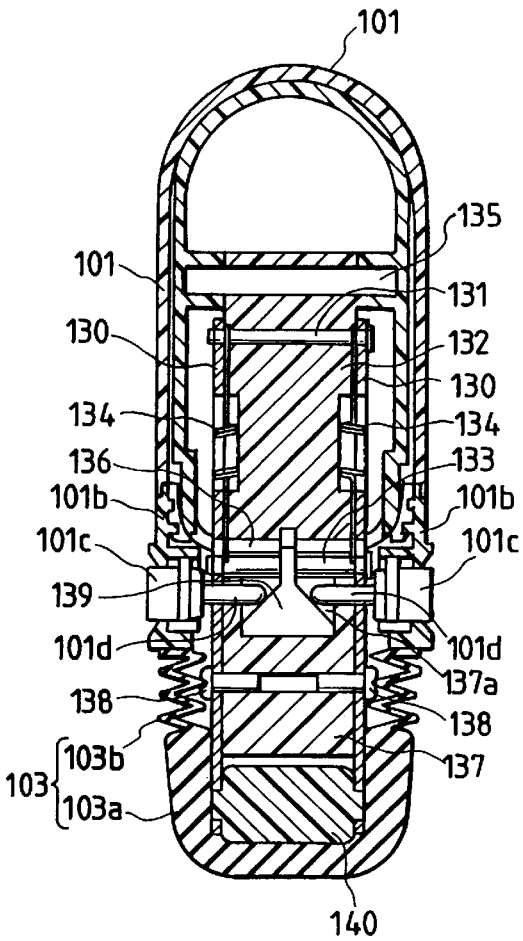

Next, driving means for the first and second massage members 102 and 103 will be described with reference to FIGS. 14, 15(*a*) and 15(*b*). FIG. 15(*a*) and 15(*b*) are section views taken along line III—III of FIG. 14 and showing the configuration of a second massage arm 113. FIG. 15(*a*) shows a state where an engaging pin is engaged, and FIG. 15(*b*) shows a state where the engaging pin is disengaged.

As shown in FIG. 14, the device body 101 incorporates:

a motor 105 functioning as a driving source; a gear reduction mechanism consisting of gears 106, 107, 108, and 109; a first driving gear 110 and a first massage arm 111 for driving the first massage member; and a second driving gear 112 and the second massage arm 113 for driving the second massage member. The rotation force of the motor 105 is transmitted to the first driving gear 110 via the gear reduction mechanism, and further transmitted from the first driving gear 110 to the second driving gear 112. The first and second driving gears 110 and 112 have the same number of teeth so as to rotate at the same speed.

First, the first massage arm 111 will be described with reference to FIG. 14.

The first massage arm 111 comprises a first arm 121 on the side of the basal end and a second arm 122 on the side of the tip end, and is configured as an articulate link mechanism which is bendable and extendable and in which the first and second arms 121 and 122 are connected to each other at each one end portion by a connecting pin 123 so as to be mutually swingable. The tip end portion of the second arm 122 is fixed to the first massage member 102.

In the area of the first massage arm 111 where the first and second arms 121 and 122 are connected to each other, an abutting pawl 124 is disposed on the second arm 122, and a stopper 125 is formed in the first arm 121 so as to nip the abutting pawl 124. The abutting pawl 124 can abut against the arm body of the first arm 121 and the stopper 125, whereby the angle formed by the first and second arms 121 and 122 is restricted to a fixed range.

A spring 126 which urges the first and second arms 121 and 122 in the bending direction is attached to the connecting pin 123. As shown in FIG. 14, usually, the resilient force of the spring 126 causes the abutting pawl 124 to abut against the arm body of the first arm 121 so as to fix the angle formed by the first and second arms 121 and 122, thereby maintaining a state in which the first massage arm 111 is slightly bent. By contrast, when an excessive force larger than the resilient force of the spring 126 is applied to the fist massage arm 111 during use, the second arm 122 is swung about the connecting pin 123 in the relief direction within a range where the abutting pawl 124 abuts against the stopper 125, thereby relieving the force.

The basal portion of the first arm 121 of the first massage arm 111 is connected to the first driving gear 110 by a support shaft 126 at a position which is deviated from the center of the gear. When the first driving gear 110 is rotated, the support shaft 126 performs a circular motion. A restriction arm 128 is attached at a position opposing the connecting portion of the first and second arms 121 and 122 so as to be rockable about a stationary support shaft 127 fixed to the device body 101. The tip end portion of the restriction arm 128 is attached to the connecting pin 123.

The operation of the first massage member 102 will be described. When the support shaft 126 performs a circular motion about the center of the first driving gear 110 as a result of the rotation of the first driving gear 110, the connecting pin 123 rocks about the stationary support shaft 127 in the vertical direction in the figure, with a constant radius and a constant rocking amplitude which are restricted by the restriction arm 128. As a result of this rocking movement, the contact point A of the first massage member 102 where the member contacts with the area to be massaged performs a circulating motion in a clockwise direction as indicated by the one-dot chain line in FIG. 14.

Next, the second massage arm 113 will be described with reference to FIGS. 14 and 15.

As shown in FIG. 14, the second massage arm 113 consists of a link plate 130, and is attached to a rocking block 132 in a swingable manner, by a link plate fulcrum shaft 131 which is attached to the basal portion of the link plate 130. An engaging pin 133 is attached to a substantially center portion of the link plate 130. A tension spring 134 exerting an urging force in a direction along which the engaging pin 133 is disposed to approach the link plate fulcrum shaft 131 is disposed between the pin and the shaft.

The rocking block 132 is attached to the device body 101 so as to be rockable about a rocking block fulcrum shaft 135 in a lateral direction in FIG. 14. A plurality of engaging grooves 136 are formed in the tip end of the rocking block 132. The engaging pin 133 is engaged with one of the engaging grooves 136 by the urging force exerted by the tension spring 134.

As shown in FIG. 15, the link plate 130 constituting the second massage arm 113 is disposed on both the lateral sides of the rocking block 132. The link plate fulcrum shaft 131 and the engaging pin 133 are disposed across the two link plates 130 on both the lateral sides. The tension spring 134 also is disposed on both the lateral sides.

A fixing member 137 is disposed below the engaging pin 133 between the link plates 130. The fixing member 137 is fixed to the link plates 130 by fixing screws 138 which are laterally inserted. A recess 137*a* is formed in the upper end of the fixing member 137. An engagement canceling member 139 is fitted into the recess 137*a*. The engagement canceling member 139 has inclined faces which are respectively formed on the lateral sides and which downward flare. The engaging pin 133 rotatably passes through the upper end portion of the member.

The space adjust buttons 101*c* are disposed so that the head portion is slightly projected from the surface of the corresponding lateral side of the device body 101 and can be pressed into the slide cover 101*b*. Slide pins 101*d* are disposed so as to respectively contact with the bottoms of the space adjust buttons 101*c*. Each slide pin 101*d* has a tip end of a spherical shape, and is slidably passed through the corresponding link plate 130 and the fixing member 137. The tip end of each pin abuts against the corresponding inclined face of the engagement canceling member 139.

A roller 140 is rotatably attached to the lower ends of the link plates 130. The massage portion 103*a* of the second massage member 103 is attached to the second massage arm 113 via the roller 140. The roller 140 is pressingly inserted into the inner face side of the massage portion 103*a* of the second massage member 103.

According to this configuration, when the second massage arm is swung about the fulcrum shaft 131, the second massage member 103 disposed on the secondf massage arm 113 is moved in the approaching and separating directions with respect to the first massage member 102, and, when the second massage arm 113 is swung, the angle of the massage arm with respect to the approaching and separating directions is changed. The second massage member 103 is disposed on the second massage arm 113 via the roller 140 which is rotatably disposed at a tip end of the second massage arm 113. Even when the angle of the second massage arm 113 with respect to the approaching and separating directions is changed, therefore, the rotation of the roller 140 enables the angle of the second massage member 103 to be maintained constant. As a result, the area to be massaged is always adequately captured by the massage members.

In the aforementioned configuration, the massage arm supporting means may swingably support any one of the paired massage arms. The device may comprise massage arm supporting means for swingably supporting one of the massage arms, and also other massage arm supporting means for swingably supporting the other massage arm. The roller is not restricted to a column-like member, and may be a member of any shape as far as it is rotatable.

Referring again to FIG. 14, a cam shaft 141 is disposed at one end of the rocking block 132, a cam groove 142 is formed about the rotation center of the second driving gear 112, and the cam shaft 141 is engaged with the cam groove 142. As shown in FIG. 14, the cam groove 142 is formed so that the deviation amount from the center of the driving gear is changed in the rotation direction.

The operation of the second massage member 103 will be described. The change in deviation amount of the cam groove 142 causes the cam shaft 141 to rock back and forth in accordance with the rotation of the second driving gear 112. The rocking force is transmitted to the second massage member 103 via the second massage arm 113.

As described above, the device comprises the covers 102*b* and 103*b* so as to respectively cover the openings which are formed in the surface of the device body 101 so as to have a size corresponding to the movement range of the first and second massage arms 111 and 113. Therefore, a case where a finger is caught between the first and second massage members 111 and 113 and edges of the openings is prevented from occurring. Furthermore, noises which are generated by the motor 105 and the gear reduction mechanism and which leak from the interior of the device body 101 can be reduced in level. A sensation of fear which may be produced in the user by the movement of the first and second massage arms 111 and 113 can be reduced.

Figure 16:
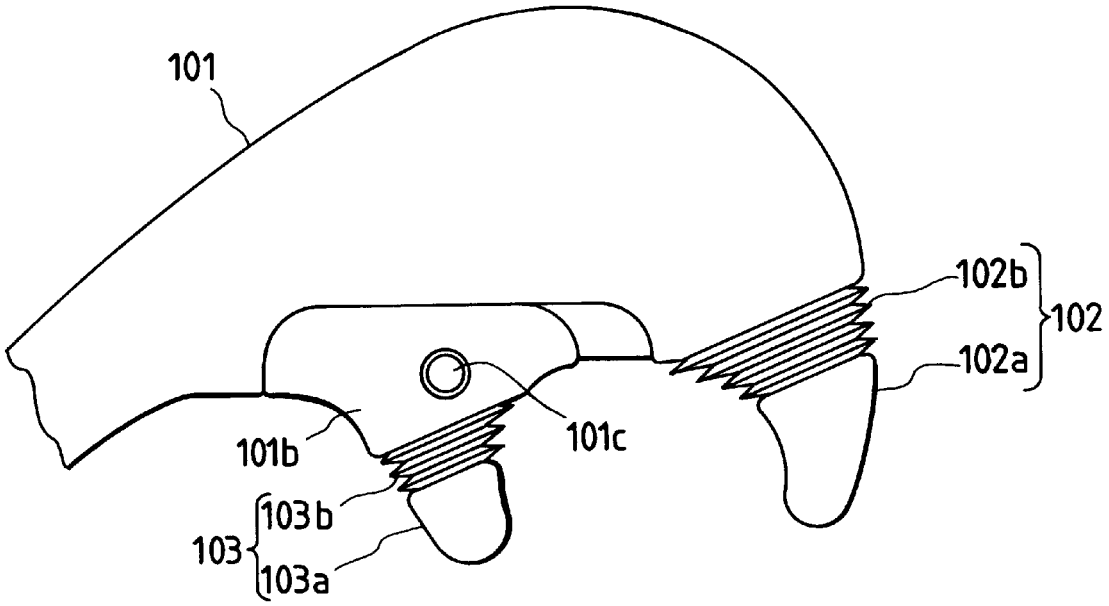
FIG. 16 is an external view showing main portions in the case where the space between the massage members is maximum.
Figure 17:
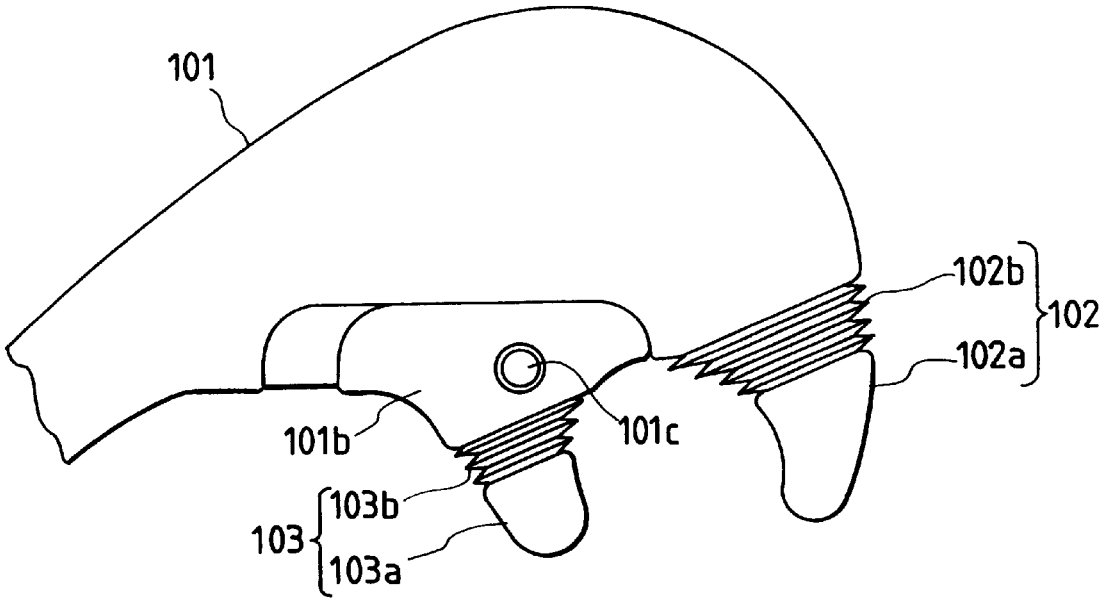
FIG. 17 is an external view showing main portions in the case where the space between the massage members is minimum.
Figure 18C:
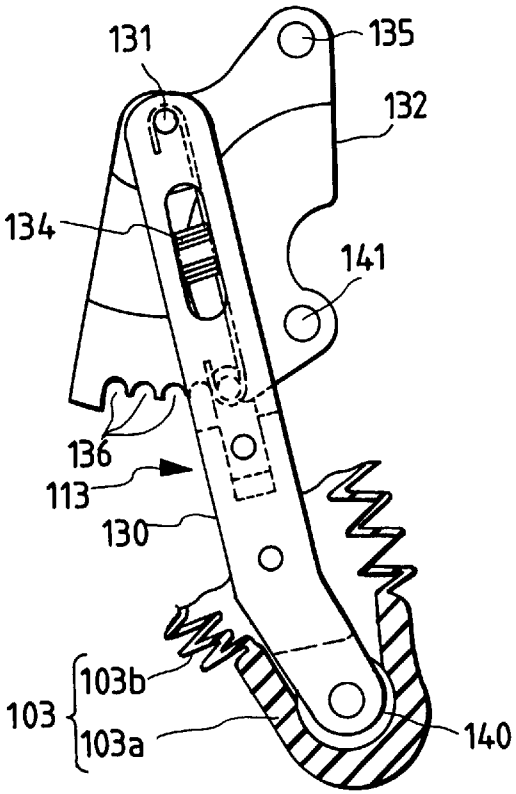
FIGS. 18(*a*) to 18(*c*) are partial section views showing positional relationships between the second massage member and the second massage arm in the case where the space adjusting operation is conducted, and, FIG. 18(*a*) shows the state where the space between the massage members has the maximum size, FIG. 18(*b*) the state where the space has an intermediate size, and FIG. 18(*c*) the state where the space has the minimum size.
Figure 18B:
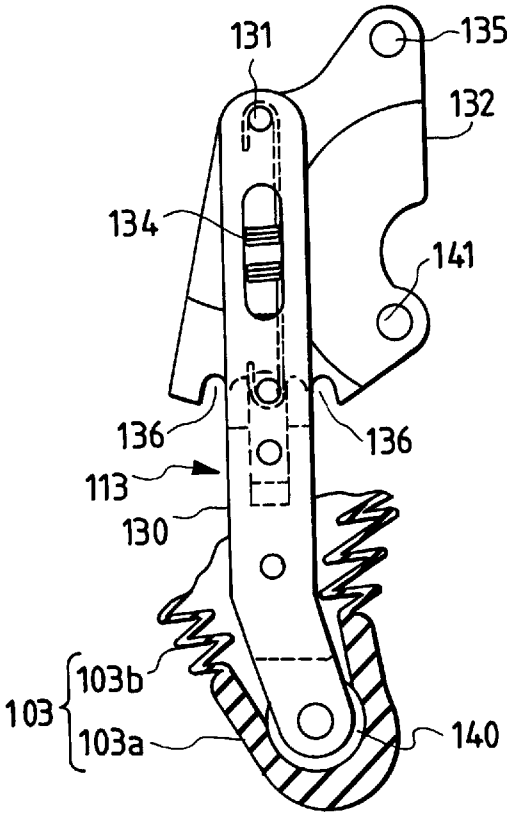
Figure 18A:
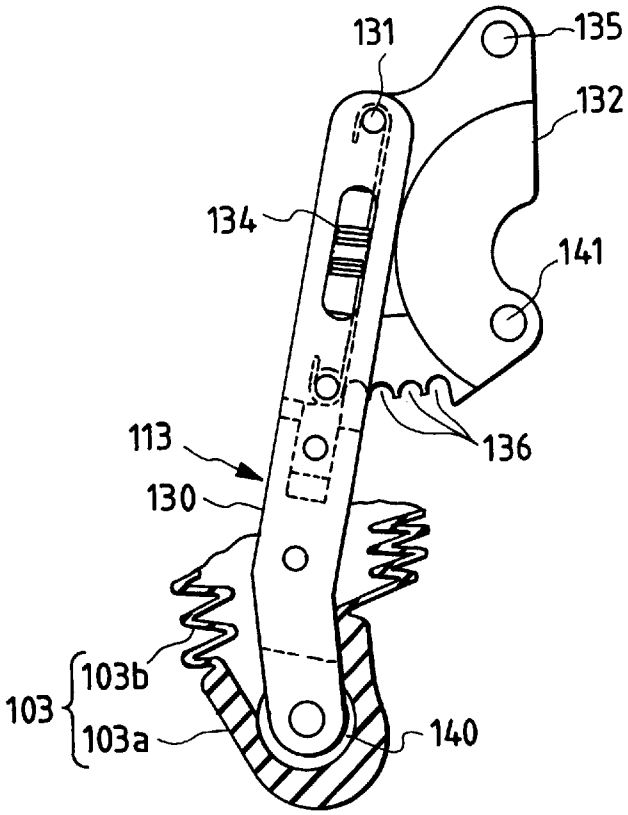

Next, the space adjusting operation of the second massage member 103 will be described with reference to FIGS. 15 to 18. FIG. 16 is an external view showing main portions in the case where the space between the massage members is maximum, and FIG. 17 is an external view showing main portions in the case where the space between the massage members is minimum. FIGS. 18(*a*) to 18(*c*) are partial section views showing positional relationships between the second massage member 103 and the second massage arm 113 in the case where the space adjusting operation is conducted. FIG. 18(*a*) shows the state where the space between the massage members has the maximum size, FIG. 18(*b*) the state where the space has an intermediate size, and FIG. 18(*c*) the state where the space has the minimum size.

As shown in FIG. 14, usually, the engaging pin 133 is urged by the tension spring 134 so as to be engaged with one of the engaging grooves 136, thereby attaining the state shown in FIG. 15(*a*). When the right and left space adjust buttons 101*c* are pressed, the slide pins 1*d* contacting with the space adjust buttons 101*c* are pushed so as to be moved toward the center, and the inclined faces of the engagement canceling member 139 receive pressing forces which are produced by the tip ends of the slide pins 101*d* and horizontally directed toward the center.

The pressing forces produces a downward force acting on the engagement canceling member 139, so that the engagement canceling member 139 is lowered with being guided by the recess 137*a* of the fixing member 137. The downward movement of the engagement canceling member 139 causes the engaging pin 133 passing through the engagement canceling member 139, to be downward pulled against the urging force of the tension spring 134. The engaging pin 133 is then disengaged from the one engaging groove 136 and the engagement is canceled, with the result that the state shown in FIG. 15(*b*) is obtained.

Under this engagement canceled state or the sate where the space adjust buttons 1*c* are pushed, when the slide cover 101*b* is leftward fully slid, the space between the massage members 1102 and 103 has the maximum size as shown in FIG. 16, and, when the slide cover 101*b* is rightward fully slid, the space between the massage members 102 and 103 has the minimum size as shown in FIG. 17.

After the space is set to a desired size by means of the sliding operation, the operation of pressing the space adjust buttons 101*c* is stopped. Then, the engaging pin 133 is elevated by the urging force of the tension spring 134 to return to the engagement state where it engages with either of the engaging grooves 136. At the same time, the engagement canceling member 139 is elevated together with the engaging pin 133, and hence the inclined faces of the engagement canceling member 139 push the slide pins 101*d* in lateral outward directions. As a result, the space adjust buttons 101*c* return their original state where the heads of the buttons are slightly projected from the surface of the device body 101.

In the configuration in which the slide movement is enabled under a state where the space adjust buttons 101*c* are pressed as described above, the space between the massage members 102 and 103 can be easily adjusted with one hand. Consequently, the space can be adjusted while the massage members 102 and 103 are pressed against the area to be massaged. When the space is to be adjusted, therefore, it is not required to change the hand holding the massage device to the other one.

When the space between the massage members 102 and 103 is adjusted by sliding the second massage member 103 as shown in FIG. 18(*a*) to 18(*c*), the tip end of the second massage arm 113 is moved in an arcuate path centered at the link plate fulcrum shaft 131. The second massage member 103 is not fixed to the tip end of the second massage arm 113, but is attached thereto via the roller 140 which is rotatably disposed. When the second massage member 103 is rocked to perform the massage action by the rocking movement of the cam shaft 141, therefore, the massaging face of the second massage member 103 always performs the massage action at a substantially same angle with respect to the area to be massaged.

According to this configuration, even when the space between the massage members 2 and 3 is adjusted in accordance with the physique of a person to be massaged, it is possible to attain a similar massage effect.

Figure 19:
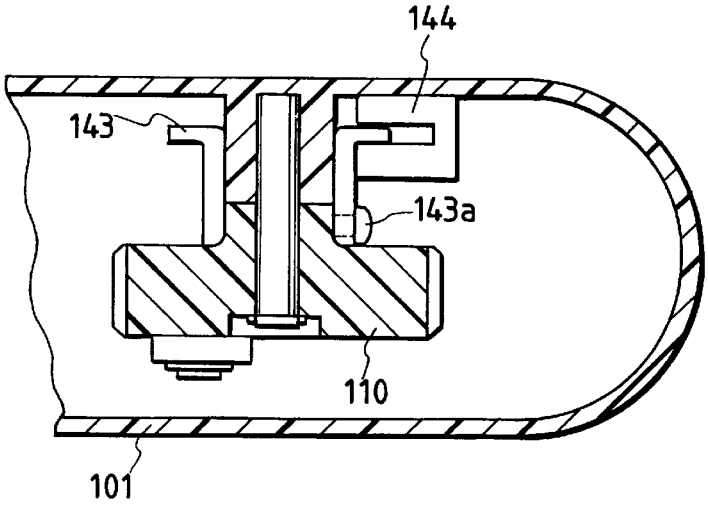
FIG. 19 is a section view of main portions of the massage device and showing the configuration of a position detecting unit.

Next, the stop control of the massage device will be described with reference to FIGS. 14, 19, and 20. FIG. 19 is a section view of main portions of the massage device and showing the configuration of a position detecting unit, and FIG. 20 is a block diagram of a control system of the massage device.

As shown in FIG. 19, a detection plate 143 and a position sensor 144 are disposed in the vicinity of the first driving gear 110. The detection plate 143 has a circular shape and is fixed to the first driving gear 110 by a detection plate fixing screw 143*a* so as to be rotated together with the first driving gear 110 and at the same speed. In the detection plate 143, as shown in FIG. 14, a slit 143*b* is formed at a predetermined position which will be described later.

The position sensor 144 comprises a light emitting portion and a light receiving portion which are disposed across the detection plate 143 as shown in FIG. 19, and detects the slit 143*b* formed in the detection plate 143. The slit 143*b* is formed at a position where, when the slit 143*b* is detected by the position sensor 144, the press width of the first massage member 102 is maximum.

Figure 20:
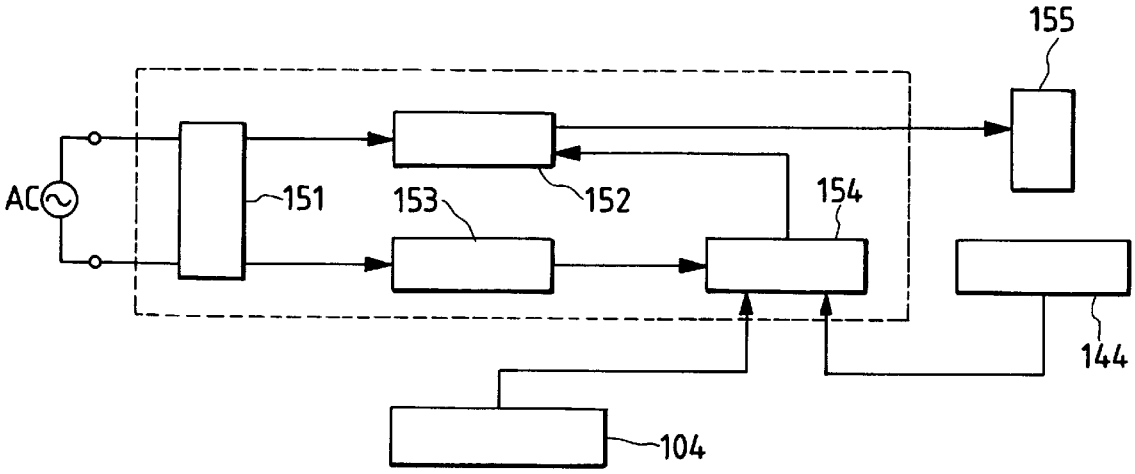
FIG. 20 is a block diagram of a control system.

As shown in FIG. 20, the control system of the massage device comprises a rectifying circuit 151, a driving circuit 152, a constant voltage circuit 153, a control circuit 154, a load 155, the operation switch 104, and the position sensor 144.

The rectifying circuit 151 comprises bridge diodes and rectifies an AC input supplied from a commercial-frequency power source AC. The driving circuit 152 comprises transistors and supplies a driving current to the load 155 consisting of the motor 105 and the like by using the voltage rectified in the rectifying circuit 151. The constant voltage circuit 153 comprises a regulator and obtains a constant voltage by using the voltage rectified in the rectifying circuit 151.

The control circuit 154 comprises a microcomputer and controls the operation of the massage device. When the operation switch 104 is turned on, the control circuit outputs a control signal to the driving circuit 152 so as to supply the driving current to the load 155, whereby the massage device is caused to operate so as to perform the massage action. Moreover, the control circuit judges whether the slit 143*b* (FIG. 14) is detected by the position sensor 144 or not.

When the operation switch 104 is turned off, the control circuit 154 does not immediately stop the operation but continues the operation. At the timing when the slit 143*b* (FIG. 14) is then detected by the position sensor 144, the control circuit outputs a control signal to the driving circuit 152 so as to stop the supply of the driving current to the load 155, thereby stopping the operation of the massage device.

In this way, the operation is always stopped under the state where the space between the massage members 102 and 103 has a given size. When the operation is to be then restarted, therefore, an index of the space adjustment can be easily obtained. Since the operation is always stopped under the state where the space between the massage members 102 and 103 has the maximum size, the device can be easily detached from the area to be massaged, and the operation can be then restarted under the state where the massage members are pressed to the area to be massaged.

Figure 21:
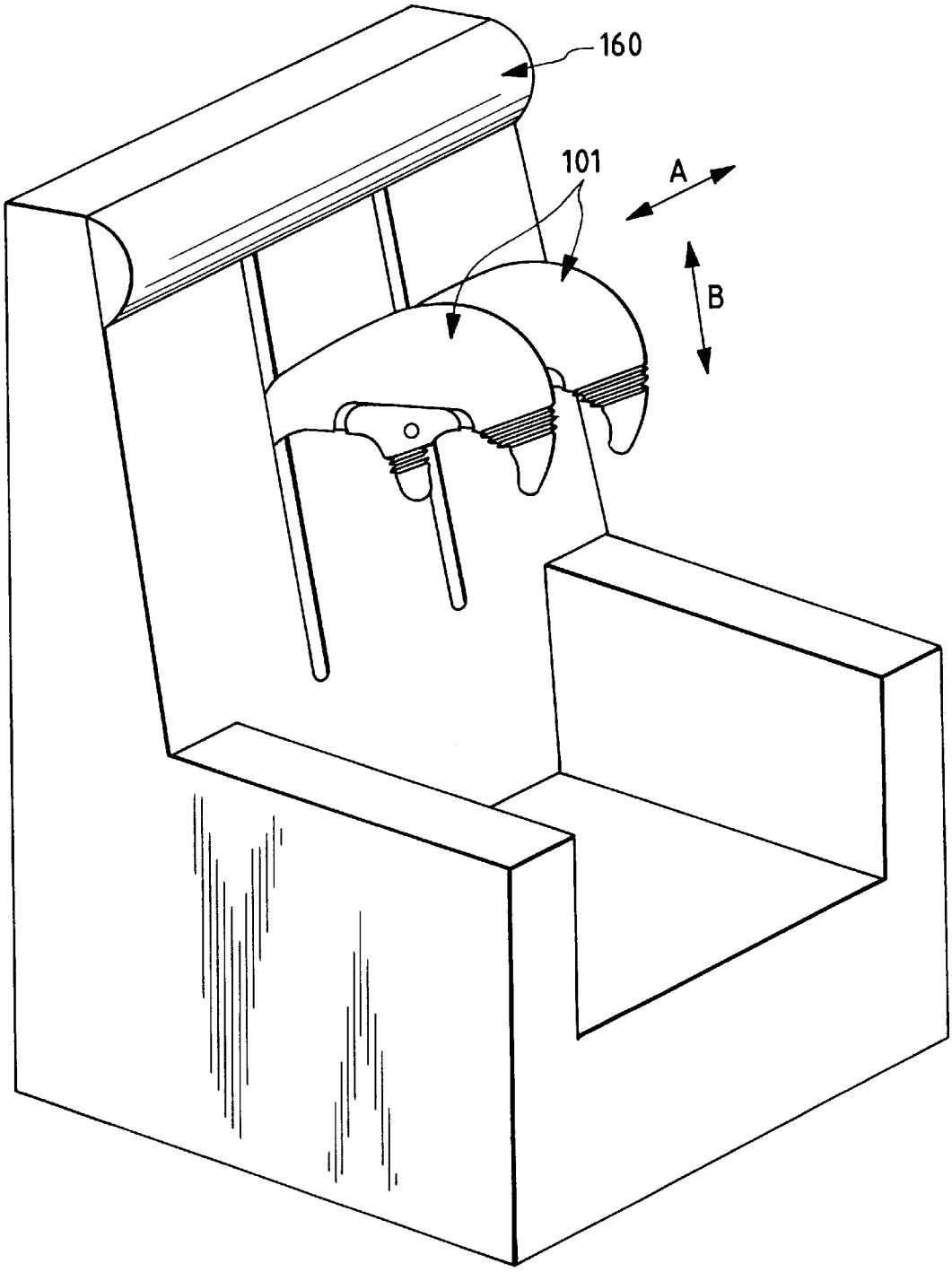
FIG. 21 is an electric massage device of chair-type into which the hand-held type massage devices in FIG. 13 are applied.

FIG. 21 is an electric massage device of chair-type into which the aforementioned embodiment of the present invention massage device is applied. That is, a pair of aforementioned hand-held type massage devices are assembled into a chair 160. The pair of massaged device are movable directions of the arrows A and B in FIG. 21 according to the phisyque of the person to be massaged.

As described above, according to the first aspect of the invention, a massage member performs a circulating motion including (i) a massage zone where the member approaches another massage member in a locus which swells in an outward direction as seen from the massage arms, and (ii) a release zone where the massage member separates from the other massage member in a locus which is shorter than the massage zone. Therefore, when a shoulder is to be massaged, for example, the massage member which performs the circulating motion slowly massages the shoulder and then rapidly separates from the shoulder, as the motion of the thumbs in the thumb-grasping massage technique conducted by a massager. Consequently, it is possible to attain a high massage effect.

In this case, according to the second aspect of the invention, the other massage member performs the rocking motion to support the pressing force exerted by the one massage member at the squeezing position, thereby enhancing the massage effect, and is then moved from the squeezing position to the release position to perform the motion of canceling the pressing force (rapidly releasing the force). Therefore, it is possible to attain a massage action which is more similar to the thumb-grasping massage technique.

According to the sixth aspect of the invention, the massage member which performs the reciprocal rocking motion stops for a predetermined time period including a timing when the massage member which performs the circulating motion reaches the endpoint of the massage zone. Therefore, it is possible to obtain a motion in which the pressing force is accumulated at the peak of massage exerted by the thumbs and then rapidly released, and hence the massage feeling becomes more similar to that exerted by a massager.

According to the seventh aspect of the invention, the other massage member stops at the squeezing position where the pressing force is maximum, and hence the effect is further enhanced.

According to the eighth aspect of the invention, as the massage proceeds, the pressing force is increased by the spring, and hence it is possible to obtain an optimum motion in which the massage is conducted while gradually increasing the pressing force.

When an excessive force is applied as in the case where a bone or the like is pressed, moreover, the arm to which the massage member is attached is swung in a relief direction so as to exert a function of preventing overload. Therefore, both the human body and the massage arms are prevented from receiving an excessive force.

According to the ninth aspect of the invention, the space between the massage members is adjustable, and hence it is possible to obtain an optimum massage span according to, for example, the physique of a person to be massaged.

According to the tenth and eleventh aspects of the invention, the massaging face of the massage member is substantially unchanged at any size of the space, and hence it is possible to ensure a constant massage effect irrespective of variation of the space.

According to the twelfth aspect of the invention, the one massage member is disposed on the one massage arm via the roller which is rotatably disposed at a tip end of the massage arm. Even when the angle of the massage arm with respect to the approaching and separating directions is changed, therefore, the rotation of the roller enables the angle of the massage member to be maintained constant. As a result, the area to be massaged is always adequately captured by the massage members. Furthermore, the massage device can give an adequate fitting sense to the area to be massaged, and attain an effect similar to an acupressure massage.

According to the thirteenth aspect of the invention, the massage device comprises the covers which are disposed between the surface of the body of the device and the massage members so as to respectively cover the openings which are formed in the surface of the body of the device and which have a size corresponding to a range of a massage operation. Therefore, a danger such as that a finger or the like is caught between the massage members and the openings can be prevented from occurring. Furthermore, noises which are generated by driving the massage members and which leak to the outside can be reduced in level. A sensation of fear which may be produced in the user by the movement of the massage arms during use can be reduced.

According to the fourteenth aspect of the invention, the engagement state of the engaging member with the one of the engaging grooves is canceled by pressing the head portion of the cancel operation member, and the massage arm is swung about the fulcrum shaft disposed on the massage arm, under this cancel state, thereby adjusting the space between the massage members which are respectively disposed at tip ends of the massage arms. Therefore, the space adjustment can be easily conducted with one hand. Furthermore, the space can be adjusted while the massage members are pressed against the area to be massaged. During the adjustment of the space, therefore, it is not required to change the hand holding the massage device to the other one.

According to the fifteenth aspect of the invention, when the driving means is instructed to stop the operation, the operation of the driving means is stopped at a timing when the space between the massage members has a preset size. When the operation is to be restarted, therefore, the space between the massage members can always have a preset size. Consequently, an index of the adjustment of the space between the massage members can be easily obtained.

What is claimed is:

1. A massage device comprising:

a first massage arm and a second massage arm;

a first massage member and a second massage member respectively disposed at ends of said first and said second massage arms; and means for driving said first massage arm such that said first massage member moves through a circulating motion including only (i) a massage zone exclusively defined by an approaching motion of said first massage member in a direction toward said second massage member, and (ii) a release zone exclusively defined by a retreating motion of said first massage member in a direction away from said second massage member;

wherein a travel distance of said first massage member through said massage zone is greater than that through said release zone.

2. The massage device according to claim 1, wherein said driving means causes said second massage member to move in a reciprocal rocking motion between a squeezing position where the space between said first massage member and said second massage member is a minimum, and a release position where the space between said first massage member and said second massage member is a maximum.

3. The massage device according to claim 2, wherein said driving means has a driving system for driving said second massage member through said reciprocal rocking motion, said driving system including:

a driving plate which is rotated by a motor;

a cam groove which is formed around a rotation center of said driving plate;

a cam shaft which engages with said cam groove; and a rocking block which is rocked about a fixed fulcrum by a cam action between said cam groove and said cam shaft, thereby rocking said second massage arm.

4. The massage device according to claim 2, wherein said driving means stops said second massage member which performs the reciprocal rocking motion, for a predetermined time period including a timing when said first massage member which performs the circulating motion reaches an endpoint of the massage zone.

5. The massage device according to claim 2, wherein said driving means stops said second massage member which performs the reciprocal rocking motion at the squeezing position of said second massage member, for a predetermined time period.

6. The massage device according to claim 1, wherein said driving means has a driving system for driving said first massage member through said circulating motion, said driving system comprising:

a rotation plate which is rotated by a motor to give a circular motion force to a motion fulcrum of said first massage arm; and a restriction arm which restricts a motion locus of said first massage arm so that said first massage member moves through said circulating motion.

7. The massage device according to claim 1, wherein said second massage arm is fixed.

8. The message device according to claim 1, wherein at least one of said massage arms is configured as an articulate link mechanism in which two arms are connected at one end to each other by a pin, and a spring which urges said two arms toward a usual action position is disposed in an arcuate portion of said one of said massage arms.

9. The massage device according to claim 1, wherein at least one of said massage arms is positionally changeable, and said massage device further comprises space adjusting means for adjusting a position of said at least one of said massage arms to change a length of a space between said pair of massage members.

10. The massage device according to claim 9, wherein said space adjusting means moves in parallel with respect to said positionally changeable massage arm such that a massaging face of said positionally changeable massage member is substantially unchanged in direction at any adjust position.

11. The massage device according to claim 10, wherein said space adjusting means is configured by a quadru-link mechanism.

12. The massage device according to claim 9, wherein said space adjusting means comprises:

a massage arm support member which supports one of said massage arms so as to be swingable about a fulcrum shaft disposed on said one massage arm, and which has a plurality of engaging grooves facing toward an end of said one massage arm;

an engaging member which is attached to said one massage arm, and which is movable between an engagement state and a cancel state with respect to said engaging grooves;

an urging member which is disposed between said engaging member and said fulcrum shaft, and which produces an urging force in an engagement direction; and a cancel operation member which has a head portion projected from a body of said device, and which, when said head portion is pressed, moves said engaging member against the urging force, thereby canceling the engagement state of said engaging member with respect to said engaging grooves.

13. The massage device according to claim 1, further comprising: a roller which is rotatably disposed at a tip end of at least one of said massage arms, and said one of said massage members is disposed on said roller.

14. The massage device according to claim 1, wherein a time during which said first massage member moves through said massage zone is longer than that through said release zone.

15. A massage device comprising:

a pair of massage arms;

a pair of massage members which are respectively disposed at tip ends of said massage arms;

driving means for driving said massage arms to change a space between said massage members, thereby causing said massage members to perform a massage action; and instructing means for instructing a stop of an operation of said driving means; and controlling means for, when said instructing means produces an instruction, stopping the operation of said driving means at a timing when the space between said massage members has a preset size;

wherein said driving means drives a first massage arm of said pair of massage arms, such that a first massage member of said pair of massage members moves through a circulating motion including only, (i) a massage zone exclusively defined by an approaching motion of said first massage member in a direction toward a second massage member of said pair of massage members, and (ii) a release zone exclusively defined by a retreating motion of said first massage member in a direction away from said second massage member; and wherein a travel distance of said first massage member through said massage zone is greater than that through said release zone.

16. A massage device comprising:

a pair of massage arms;

a pair of massage members being respectively disposed at tip ends of said massage arms;

means for driving a first massage arm of said massage arms and a first massage member of said massage members so as to change a space between the pair of massage members to perform a massage action;

wherein said driving means drives said first massage arm, such that said first massage member moves through a circulating motion including only (i) a massage zone exclusively defined by an approaching motion of said first massage member in a direction toward a second massage member of said pair of massage members, and (ii) a release zone exclusively defined by a retreating motion of said first massage member in a direction away from said second massage member;

wherein a travel distance of said first massage member through said massage zone is greater than that through said release zone; and wherein time during which said first massage member moves in the massage zone is longer than that in the release zone.

17. A massage device comprising:

a first massage arm and a second massage arm;

a first massage member and a second massage member respectively disposed at ends of said first and said second massage arms; and a driving mechanism that drives said first massage arm such that said first massage member moves through a circulating motion including only (i) a massage zone exclusively defined by an approaching motion of said first massage member in a direction toward said second massage member, and (ii) a release zone exclusively defined by a retreating motion of said first massage member in a direction away from said second massage member;

wherein a travel distance of said first massage member through said massage zone is greater than that through said release zone.

* * * * *